US005555311A

United States Patent [19]

Reams

[11] Patent Number: 5,555,311

[45] Date of Patent: Sep. 10, 1996

[54] ELECTRO-ACOUSTIC SYSTEM ANALYZER

[75] Inventor: Robert W. Reams, Lynnwood, Wash.

[73] Assignee: Electronic Engineering and Manufacturing, Inc., Mountlake Terrace, Wash.

[21] Appl. No.: 222,629

[22] Filed: Apr. 1, 1994

[51] Int. Cl.[6] ..... H04R 29/00

[52] U.S. Cl. ..... 381/58

[58] Field of Search ..... 381/55, 58, 59, 381/97, 73

[56] References Cited

U.S. PATENT DOCUMENTS

| | | | |
|---|---|---|---|
| 4,258,314 | 3/1981 | Hirata | 324/57 R |
| 4,346,268 | 8/1982 | Geerling | 179/175.1 A |
| 5,230,022 | 7/1993 | Sakata | 381/97 |

FOREIGN PATENT DOCUMENTS

| | | | |
|---|---|---|---|
| 60-254994 | 12/1985 | Japan | 381/59 |
| 62-149300 | 7/1987 | Japan | 381/59 |
| 62-219800 | 9/1987 | Japan | 381/58 |
| 2109500 | 10/1988 | Japan | 381/59 |

*Primary Examiner*—Edward L. Coles, Sr.
*Assistant Examiner*—Jerome Grant, II
*Attorney, Agent, or Firm*—Seed and Berry LLP

[57] ABSTRACT

A method and apparatus for analyzing performance parameters of an electro-acoustic system. The bandwidth of the electro-acoustic system is determined by applying a broad band stimulus signal to its input, and picking up the resulting acoustic signal with a microphone. The microphone output is then applied to a state variable filter having a low-pass filter output, a high-pass filter output, and a band-pass filter output. The operating frequency of the state variable filter is changed incrementally through each of a plurality of frequencies. The high and low frequency responses of the electro-acoustic system is determined on the basis of the operating frequencies of the state variable filter at which accumulated values of the outputs of the state variable filter bear certain relationships to each other. The thermal power limit of the electro-acoustic system is analyzed by applying a gradually increasing random noise signal to the input, and monitoring the amplitude of the resulting acoustic signal to determine when the acoustic signal no longer tracks the input signal. The equalizability of the electro-acoustic system is determined by comparing the phase of a swept input signal with the phase of the resulting acoustic signal and displaying the change in phase per spectra. Finally, the spurious vibration of the electro-acoustic system is analyzed by generating a noise signal having its frequency components excluded at swept frequency, and detecting any resulting acoustic signal at the excluded frequency.

70 Claims, 8 Drawing Sheets

ELECTRO-ACOUSTIC SYSTEM ANALYZER

TECHNICAL FIELD

This invention relates to audio test equipment, and, more particularly, to a system for automatically analyzing a variety of performance parameters of an electro-acoustic system.

BACKGROUND OF THE INVENTION

Electro-acoustic systems are in common use in a variety of forms, most commonly in home stereo systems. These electro-acoustic systems receive an electrical input, for example, from a compact disc (CD) player or a tape deck, amplify the input signal significantly, and then apply it to two or more acoustic transducers, e.g., loud speakers. Although the performance of such systems is often judged quite subjectively, there are a number of objective performance parameters associated with electro-acoustic systems. The most important of these parameters is the frequency response of the electro-acoustic system, both in terms of its bandwidth between low and high cutoff frequencies and the degree of amplitude variation between those cutoff frequencies.

The frequency response of an electro-acoustic system is typically measured by applying a stimulus signal to the electrical input of the system, and picking up the resulting acoustic signal with a calibrated microphone. The microphone output signal is then examined to determine the frequency response of the electro-acoustic system. The frequency response can be measured in either the time domain or the frequency domain. The frequency response is generally measured in the frequency domain by applying a constant amplitude, swept frequency sign wave to the input of the system, and measuring the amplitude of the microphone output signal. The frequency of the input signal is generally plotted along the X-axis of a display while the intensity of the amplitude of the microphone output signal is plotted along the Y-axis. Frequency response can be measured in the time domain by applying a stimulus pulse to the input of the system, and then performing a fast Fourier transform on the resulting pulse at the output of the microphone.

Regardless of whether the frequency response of an electro-acoustic system is measured in the time domain or the frequency domain, the results are less than optimum. The primary limitation on either approach is the subjective manner in which the high and low cutoff frequencies are identified. In theory, the high and low cutoff frequencies are the frequencies at which the amplitude of the transfer function from the output of the system to its input falls 3 dB from the presumably flat amplitude between the cutoff frequencies. However, there are two fallacies to this approach. First, the transfer function of the electro-acoustic signal is not exactly flat between the upper and lower cutoff frequencies. Thus, there is often no clear 0 dB point that can be used as a reference to determine when the transfer function is 3 dB down from the reference point. Second, the conventional approach assumes that the transfer function rolls off smoothly at the high and low cutoff frequencies. In reality, the transfer function is normally composed of a series of peaks and troughs created by imperfections in the acoustic transducers which often make the frequency at which the transfer function is "3 dB down" impossible to determine accurately. Thus, under many circumstances, a subjective guess is made to determine the bandwidth of the electro-acoustic system. Furthermore, measuring the bandwidth of an electro-acoustic system using the conventional approach is quite time-consuming, and to achieve even fairly accurate results, it must be performed by a fairly skilled technician.

Another important performance parameter of an electro-acoustic system is its thermal limit. Acoustic transducers, such as loud speakers, are generally rated by their manufacturers as being capable of handling a specified power. However, well before this power limit is reached, the voice coil of the transducer become quite hot. As the temperature of the coil increases, the impedance of the coil markedly increases, thus limiting the power that is being applied to the acoustic transducer. Accurate data specifying efficiency loss resulting from voice coil heating is generally not specified by the manufacturer, and there does not seem to be any standard relationship between the power capabilities of the transducer and the power at which efficiency decreases. Thus, under most circumstances, it is not possible to determine the acoustic power that a transducer is actually capable of delivering. The problem becomes even more acute when different transducers in a multi-transducer array reach their thermal limits at different applied powers. Under these circumstances, the multi-transducer array performs in one manner at relatively low applied power and performs in an entirely different manner at significantly higher powers when some of the transducers in the array have reached their thermal limits. Under these circumstances, a variety of dynamic frequency response aberrations and polar shifts can occur.

Another critical performance parameter of electro-acoustic systems is group delay which can be useful in identifying dips that can be corrected through equalization. In a multi-transducer array, it is usually assumed that the transducers behave in the same manner and thus act as one large transducer. In reality, since the transducers are spaced apart from each other, nulls occur as the acoustic signals from each of the transducers interact constructively and destructively. These nulls cannot be corrected by simply applying more power to the acoustic transducer at the null frequency through equalization. Other localized amplitude reductions are not caused by interference between two or more acoustic transducers. These amplitude reductions, known as "dips," are correctable through equalization. It is important to be able to differentiate between equalizable dips and unequalizable nulls because attempting to correct unequalizable nulls by simply pumping more power into the acoustic transducer can cause damage and degrade performance. Equalizable dips are amplitude reductions in which the amplitude reduction is accompanied by phase shifts between the input and output of the system that are substantially the same at frequencies below and above the frequency of the dip. In other words, a dip is equalizable if the phase shift between the output and input of the system varies at the dip frequency but is the same at frequencies below and above the dip frequency. If, however, the phase shift between the input and output of the electro-acoustic system shifts from one value below the frequency of the amplitude reduction to a substantially different value above that frequency, a null exists that cannot be corrected through equalization. The difficulty in determining the phase shift and related group delay parameter of electro-acoustic systems has limited the ability to differentiate between correctable dips and incorrectable nulls in electro-acoustic systems.

Still another performance parameter of electro-acoustic systems is spurious vibrations that may be generated by either the electro-acoustic system itself or the environment in which the electro-acoustic system is installed. Spurious vibrations are characterized as vibrations at a frequency other than the frequency of the acoustic signal. For example, a strong acoustic signal at one frequency may cause walls, door panels, glass panels or any other type of mechano-acoustic narrow band absorber to vibrate at the resonant frequency of the absorber. It can often be very difficult to diagnose and correct these spurious vibrations because they are often intermittent and occur at only specific frequencies which may be present only momentarily in a musical work. As a result, it has been extremely difficult and time-consuming to identify the causes of spurious vibrations and to correct those vibrations once their sources are identified.

In summary, while the above described performance parameters in electro-acoustic systems have been analyzed by skilled technicians using sophisticated laboratory equipment to perform time-consuming tests, there has heretofore not been any device that is capable of quickly and easily analyzing a variety of electro-acoustic performance parameters by relatively untrained personnel.

SUMMARY OF THE INVENTION

It is an object of the invention to provide a method and apparatus for comprehensively analyzing the performance of an electro-acoustic system.

It is another object of the invention to provide a method and apparatus for analyzing a variety of performance parameters of an electro-acoustic system with a minimum of operator interaction.

It is another object of the invention to provide a method and apparatus that is capable of unambiguously determining the bandwidth of an electro-acoustic system despite apparent ambiguities in the frequency response of the system.

It is another object of the invention to provide a method and apparatus for quickly and easily determining the thermal limit and/or mass of an electro-acoustic system.

It is another object of the invention to provide a method and apparatus for quickly and easily determining the group delay of an electro-acoustic system.

It is another object of the invention to provide a method and apparatus for displaying the group delay characteristics of an electro-acoustic system in a manner that readily permits a determination of whether nulls are correctable through equalization.

It is still another object of the invention to provide a method and apparatus for quickly and easily determining whether there are any spurious vibrations in an electro-acoustic system or the environment in which such system is installed.

These and other objects of the invention are provided by a method and apparatus for analyzing a variety of parameters on an electro-acoustic system of the type having an electronic input that receives an electrical signal and an acoustic transducer generating an acoustic sisal corresponding to the electrical signal. In one aspect of the inventive analyzer, the bandwidth of the electro-acoustic system is determined by connecting a stimulus source to the electronic input of the electro-acoustic system. The stimulus source may be either broad band noise or a sine wave from an oscillator controlled by a microprocessor to cause a primary frequency component of the oscillator output signal to sweep from one portion of a frequency spectrum to another. In the case where the stimulus source is an oscillator, the microprocessor preferably sweeps the primary frequency component of the oscillator output signal from a relatively high frequency to a relatively low frequency, and it causes the primary frequency component to incrementally change to each of a plurality of discrete frequencies at a zero crossing of the oscillator output signal. The oscillator output signal is also preferably maintained at each frequency for the same duration so that the oscillator output signal has a substantially rectangular frequency spectrum. A microphone acoustically coupled to the acoustic transducer of the electro-acoustic system generates an output signal corresponding to the acoustic signal. The microphone is connected to a low-pass filter and a high-pass filter each of which have the same cutoff frequency, and a band-pass filter having a center frequency that is the same as the cutoff frequency of the low-pass and high-pass filters. The filters are controlled by the microprocessor so that the cutoff frequency and the band-pass frequency are at a common specified frequency that sweeps through at least a portion of the frequency spectrum either in the presence of the noise signal or while it is repetitively swept from one portion of the frequency spectrum to the other. The outputs of the filters are convened to respective distal words, and, after the filters have been swept over the frequency range of interest, three sets of digital words are provided each of which contain a record of the amplitudes of signals at the output of a respective filter at a plurality of specified frequencies. The digital words in each of the sets are accumulated to provide a respective accumulated value for each of the high-pass, low-pass, and band-pass filters. The high frequency response of the electro-acoustic system is established as the specified frequency at which the accumulated value for the band-pass filter is substantially equal to the accumulated value for the low-pass filter. The low frequency response of the electro-acoustic system is established as the specified frequency at which the accumulated value for the band-pass filter is substantially equal to the accumulated value for the high-pass filter.

In another aspect of the invention, the phase shift and group delay of the electro-acoustic system is determined by causing the oscillator connected to the electronic input of the electro-acoustic system to sweep its primary frequency from one end of a frequency spectrum to another. The microprocessor then differences the phase of the signal applied to the electronic input of the electro-acoustic system to the phase of the microphone output signal. Based on this phase comparison, the microprocessor determines the phase shift and group delay of the electro-acoustic system as a function of the primary, frequency component of the oscillator output signal.

In still another aspect of the invention, the thermal limit of the electro-acoustic system is determined by coupling a random noise generator to the input of a variable gain circuit. The microprocessor controls the variable gain circuit to generate at its output a noise signal that gradually increases in intensity,. This increasing intensity noise signal is applied to the electronic input of the electro-acoustic system, and the resulting acoustic noise signal output by the acoustic transducer is picked up by the microphone and applied to the microprocessor through an analog-to-digital converter. The microprocessor then monitors both the amplitude of the noise signal applied to the electronic input and the amplitude of the signal output from the microphone. As a result, the microprocessor is able to detect when the amplitude of the microphone output signal no longer matches the amplitude of the noise signal output from the variable gain circuit which occurs when the thermal limit of the electro-acoustic system is reached. The low frequency components of the noise signal output by the variable gain circuit are preferably attenuated as a function of the aforementioned test so that excessive low frequency power is not applied to the transducer. The microprocessor may further determine the thermal mass of the electro-acoustic system by causing the variable gain circuit to reduce the amplitude of the noise signal to a sufficient level and for a sufficient period to allow the acoustic transducer to cool after the system has completed its thermal limit analysis. The microprocessor determines thermal mass by causing the variable gain circuit to quickly increase the power delivered to the acoustic transducer to the known thermal limit, and thereafter monitoring and logging the amplitude of the microphone output signal. As the acoustic transducer heats, the microprocessor detects a predetermined decrease in the amplitude of the microphone output signal, and determines the thermal mass as a function of the elapsed time from the increase in power delivered to the acoustic transducer to the detection of the predetermined decrease in the amplitude of the microphone output signal.

In a final aspect of the invention, the spurious vibration of the electro-acoustic system is determined by applying the noise signal output from the noise generator to a band-reject filter that attenuates frequency components within a predetermined band of frequencies centered at a specified frequency. The filtered noise signal is then applied to the electronic input of the electro-acoustic system. The resulting acoustic signal generated by the acoustic transducer is picked up by the microphone and applied to a band-pass filter having a pass-band centered at the same frequency as the reject-band of the band-reject filter. The microprocessor causes the common band-reject frequency of the band-reject filter and the pass-band frequency of the band-pass filter to scan within the frequency spectrum separated by an excess phase test. By monitoring the intensity of the band-pass filtered microphone output, the analysis system is able to detect spurious vibration signals that are picked up by the microphone at frequencies that are not present in the acoustic signal generated by the acoustic transducer.

DETAILED DESCRIPTION OF THE INVENTION

Figure 1A:
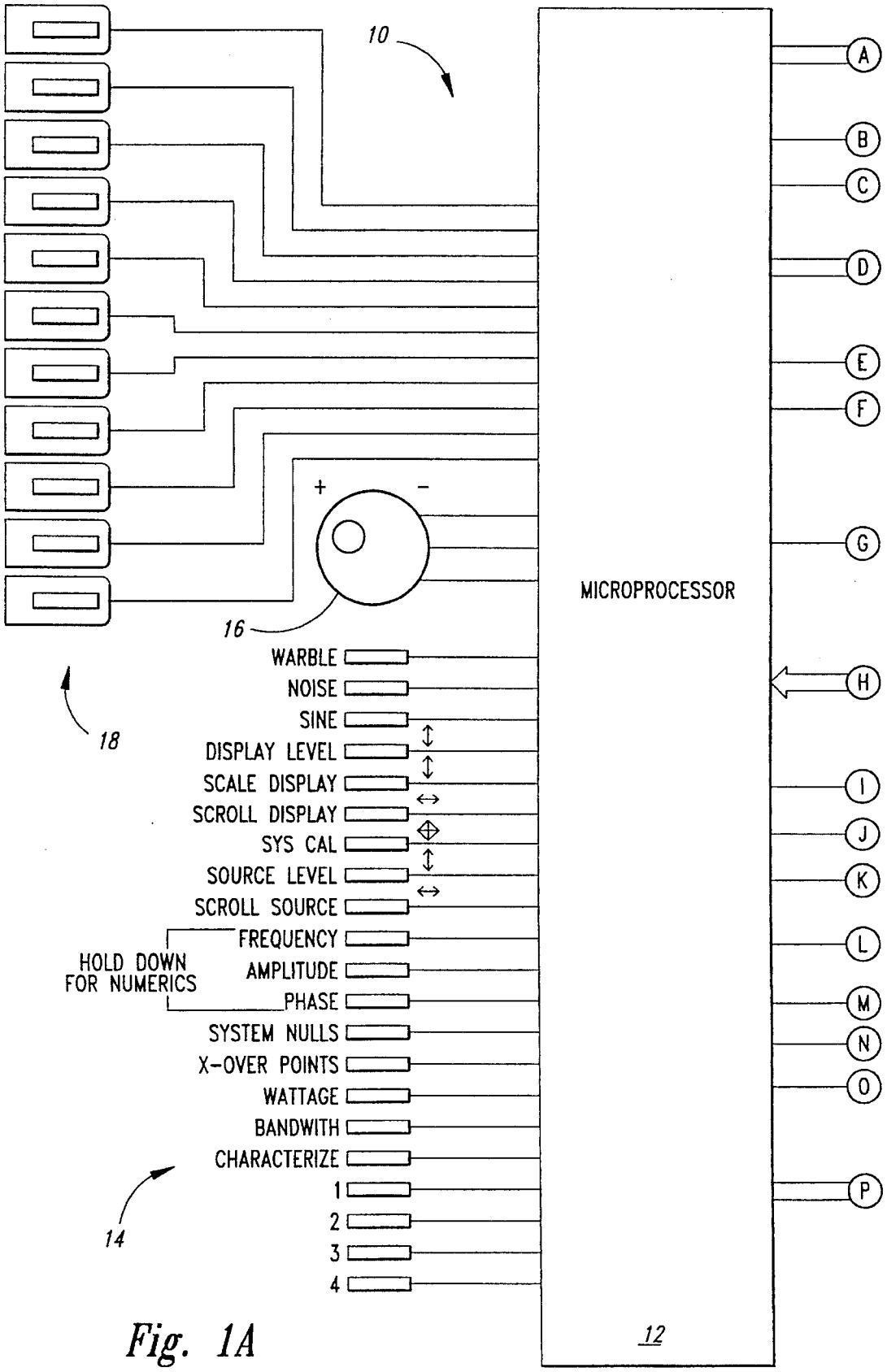
FIG. 1 is a block diagram of the inventive system for analyzing the performance parameters of an electro-acoustic system.
Figure 1B:
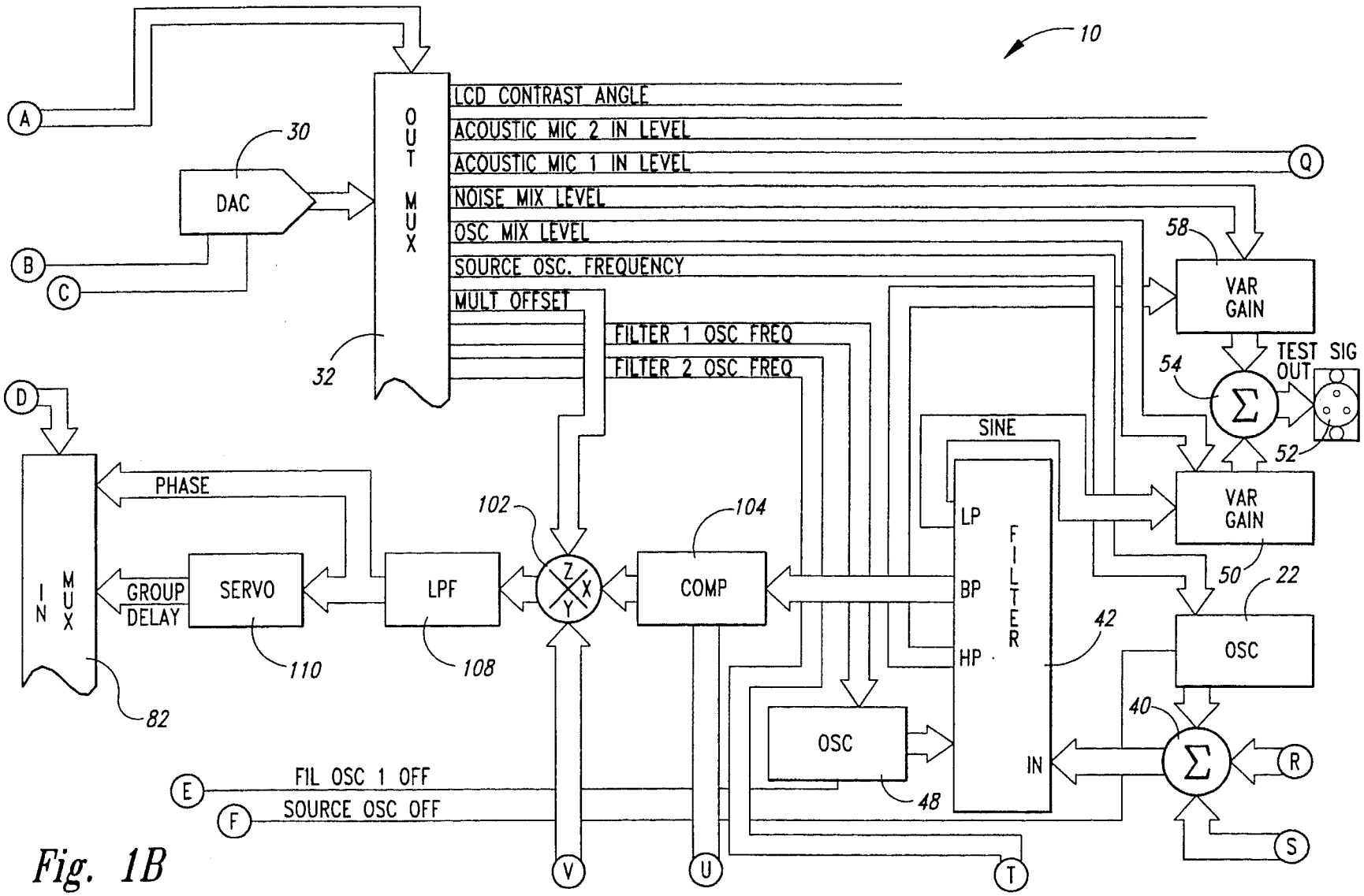
Figure 1C:
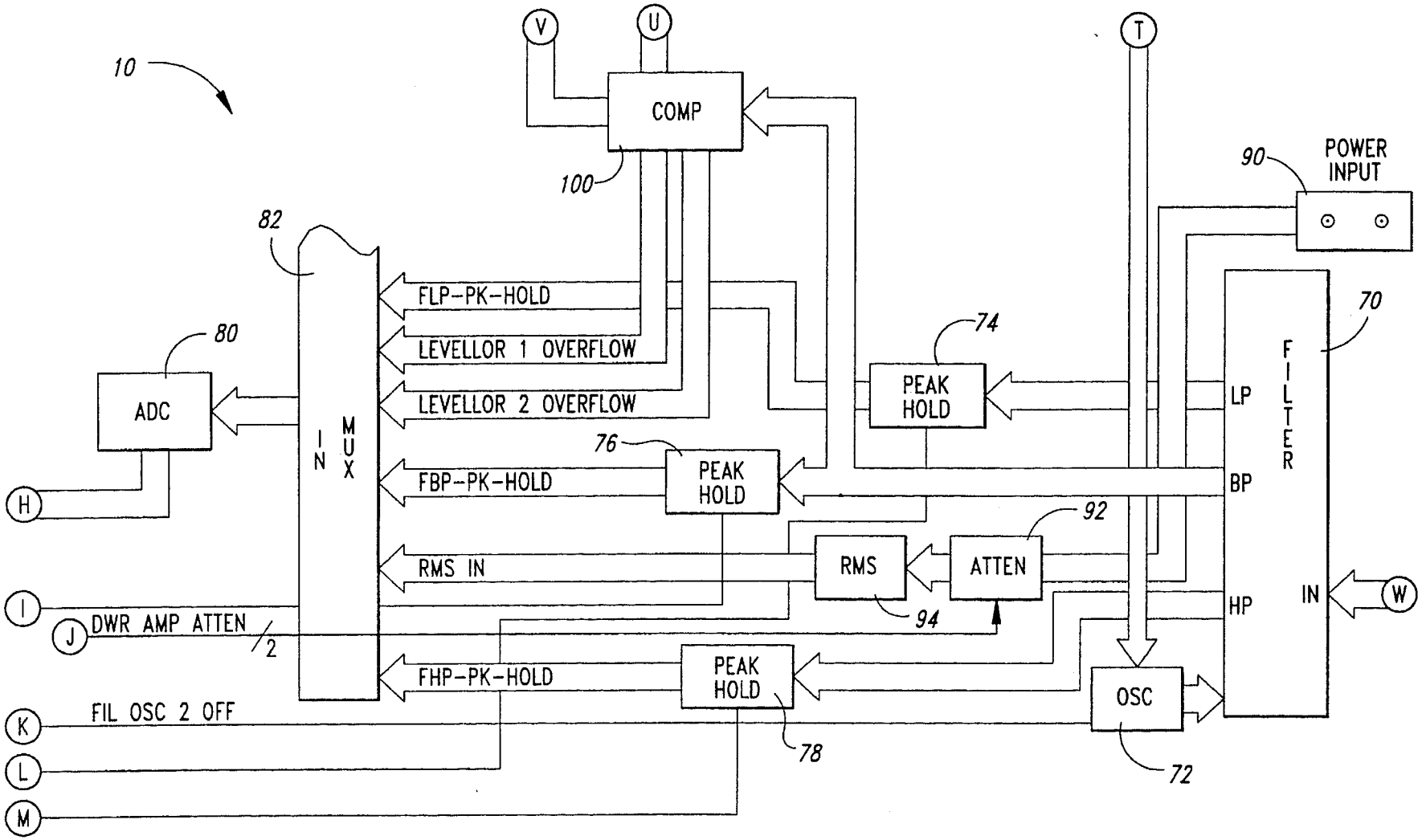
Figure 1D:
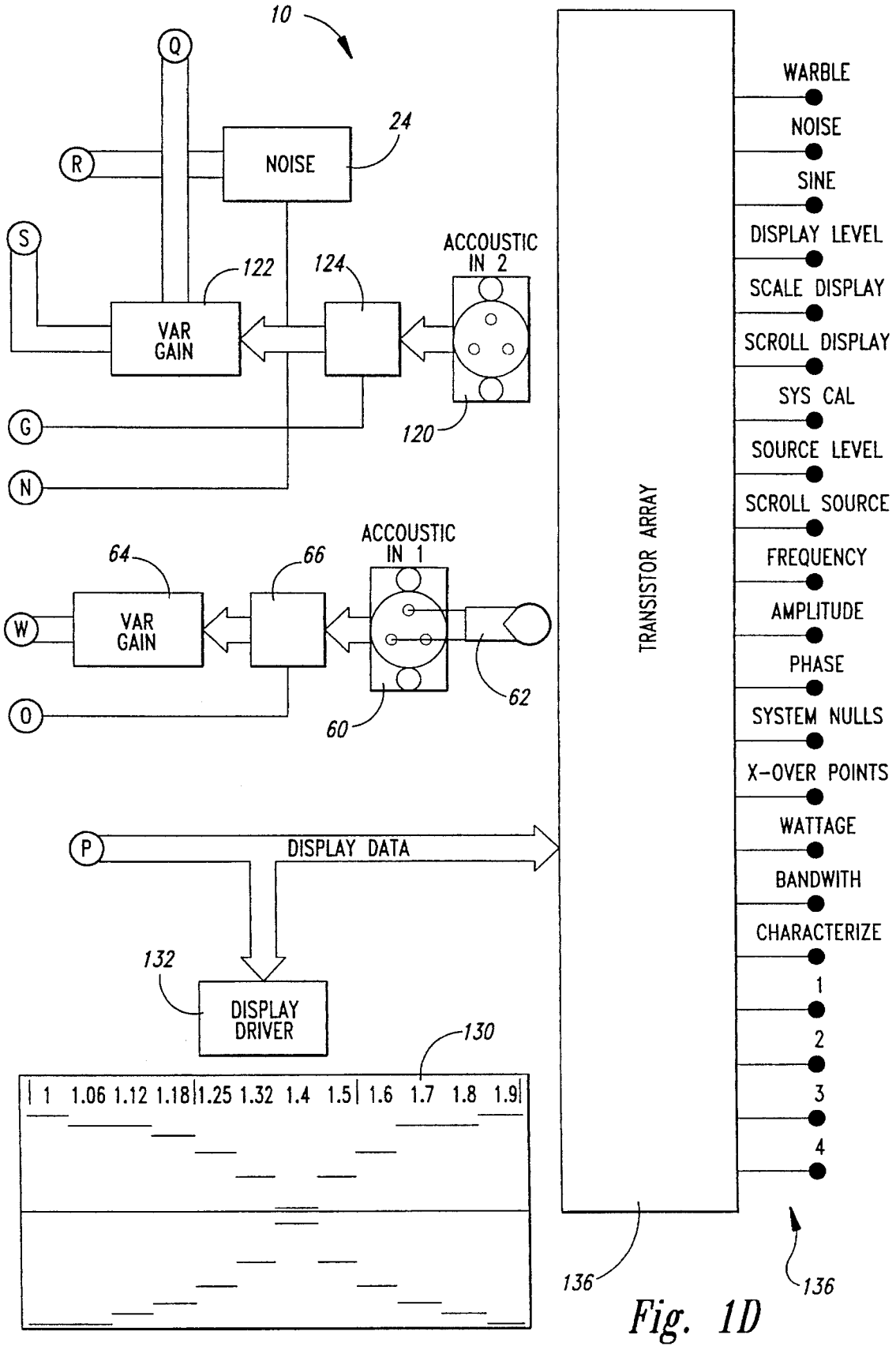

A block diagram of the inventive analyzer system for electro-acoustic systems is illustrated in FIG. 1. The operation of the system 10 is controlled by a microprocessor 12 of conventional design. The software that is used to program the microprocessor 12 will be explained in detail below. The microprocessor 12 receives, at respective input ports, single bit digital signals from a plurality of switches, indicated generally at 14. As explained below, the switches determine the nature of the stimulus signal, the amplitude, frequency and phase of the stimulus, specify the type of test that is to be conducted, and input other information to the microprocessor 12. A digital volume control 16 is connected to 3 analog ports of the microprocessor 12 to provide a signal for selecting the amplitude of a stimulus signal applied to the electro-acoustic system. Another series of switches, indicated generally at 18, are connected to the microprocessors 12 through respective ports. The switches 18 correspond to the octaves of the audio bandwidth, i.e., 20 Hz, 40 Hz, 80 Hz, 160 Hz, 320 Hz, 640 Hz, 1280 Hz, 2.5 KHz, 5 KHz, 10 KHz, and 20 KHz. As explained below, these switches 18 are used to select the low and high frequency limits of a swept frequency sine wave stimulus signal applied to the electro-acoustic system.

To the right of the microprocessor 12, as shown in FIG. 1, are the remaining components of the system 10. These components basically consist of a stimulus system for providing an electrical signal to the electrical input of the electro-acoustic system, an analysis subsystem that receives an electrical signal from a microphone that picks up an acoustic signal from an acoustic transducer of the electro-acoustic system, and a display subsystem for providing a visual display of the operating status of the analysis system or of the results from an analysis. The microphone output signals are then analyzed to provide a visual indication of a number of performance parameters.

The initial source of the stimulus signal is either an oscillator signal from a source oscillator 22, or a random noise signal from a random noise generator 24 of conventional design. The oscillator 22, which may be a conventional voltage controlled oscillator ("VCO"), is turned on and off by a "SOURCE OSC OFF" signal from the microprocessor 12, and its operating frequency is controlled by an analog control signal generated by the microprocessor 12 through a digital-to-analog ("DA") converter 30 and an output multiplexer 32 controlled by the microprocessor 12. Similarly, the noise generator 24 is turned on and off by a "NOISE INHIBIT" signal generated by the microprocessor 12. The output of the oscillator 22 and the output of the noise generator 24 are applied to an analog summer 40 having an output connected to the input of a state variable filter 42. The summer 40 may be implemented by a conventional operational amplifier summary circuit. As explained below, the state variable filter 42 performs the functions of low-pass filtering, high-pass filtering and band-pass filtering the signal applied to its input, and applies these filtered output signals to respective outputs. The state variable filter 42 may be a "DUAL CHANNEL SECOND ORDER SWITCHED CAPACITOR FILTER" sold by National Semiconductor as part number LMF100CCN. The cutoff frequencies of the low-pass and high-pass filters and the band-pass frequency of the band-pass filter is determined by the frequency of a signal applied to a frequency control input of the state variable filter 42 by a frequency control oscillator 48. The frequency control oscillator 48 may be the same circuit as the oscillator 22, and it is thus controlled in the same manner as the source oscillator 22 by the microprocessor 12 through the digital-to-analog converter 30 and the output multiplexer 32, and it is turned on and off by a "FILOSC 1 OFF" signal from the microprocessor 12. When the source of the stimulus signal is the oscillator 22, the source signal is low-pass filtered by the state variable filter 42 and applied to a variable gain circuit 50. The variable gain circuit may be a "VOLTAGE CONTROLLED AMPLIFIER" sold by Analog Services as model number SSM2024. The gain of the variable gain circuit 50 is controlled by an analog "OSC MIX SIGNAL" generated by the microprocessor 12 through the digital to analog converter 30 and output multiplexer 32. The variable amplitude sign wave from the filter 42 is then applied to a test signal connector 52 through a summer 54.

In the case where the source signal is the random noise signal from the noise generator 24, it is high-pass filtered by the state variable filter 42 and applied to another variable gain circuit 58. The gain of the variable gain circuit 58 is controlled by an analog "NOISE MIX LEVEL" signal generated by the microprocessor 12 through the digital to analog 30 and output multiplexer 32. The variable amplitude noise signal of the output of the variable gain circuit 58 is then also applied to the test signal jack 52 through the summer 54.

The above-described components constitute the stimulus subsystem of the analysis system 10. The remaining components are essentially part of the analysis subsystem or the display subsystem. The primary analysis signal path is from a connector 60 that is adapted to receive a signal from a conventional calibrated microphone 62. The microphone 62 picks up the acoustic signal generated by an acoustic transducer (not shown) forming part of the electro-acoustic system which receives its stimulus signal through connector 52. The resulting electrical signal output by the microphone 62 is applied to another variable gain circuit 65 through a conventional preamplifier 66 having two gain levels as determined by an "ACOUSTIC IN 1 PAD" signal from the microprocessor 12. The variable gain circuit 64 boosts the microphone output signal by an amount determined by an analog "ACOUSTIC MIC 1 IN LEVEL" signal generated by the microprocessor 12 through the digital-to-analog converter 30 and output multiplexer 32. The output of the variable gain circuit 64 is applied to another conventional state variable filter 70 which, like the state variable filter 42, performs the functions of low-pass filtering, high-pass filtering and band-pass filtering the input signal. Also, like the state variable filter 42, the low-pass and high-pass cutoff frequencies and the band-pass frequency of the filter 70 are controlled by the frequency of a signal generated by a filter oscillator 72. The operating frequency of the oscillator 72 is controlled by an analog "FILTER 2 OSC FREQ" signal output by the microprocessor 12 through the digital-to-analog converter 30 and output multiplexer 32. The oscillator 72 is switched on and off by a "FIL OSC 2 OFF" signal generated at an output port of the microprocessor 12.

The outputs of the filter 70 are applied to respective, conventional peak hold circuits 74, 76, 78 which sample their respective filter output at a time determined by a bit from the microprocessor 12. The outputs of the peak hold circuits 74–78 are thus voltages indicative of the peak amplitudes of the respective outputs of the filter 70. These amplitude indicative signals are applied to an analog to digital converter 80 through an input multiplexer 82 under control of the microprocessor 12. The analog-to-digital converter 80 sequentially outputs a multi-bit word indicative of the amplitude of each filter output.

Another analysis signal is applied to a pair of power input terminals 90 from the terminals of an acoustic transducer in the electro-acoustic system. The signal applied to the power input terminals 90 are coupled through a conventional attenuator 92 to a conventional RMS converter 94 that provides an analog signal indicative of the power of the signal applied to the RMS converter 94. The gain of the attenuator 92 is controlled by a two bit "PWR AMP ATTEN" signal from the microprocessor 12 to match the signal applied to the power input terminals 90 to the operating range of the RMS converter 94. As explained below, by receiving the signal applied to the acoustic transducer of the electro-acoustic system, the analysis system 10 is able to determine the power of the acoustic signal being applied to an "AMPLITUDE COMPRESSOR" sold by That Corp. as model number 4301.

The band-pass output of the state variable filter 70 is also applied to a conventional compressor circuit 100, such as the compressor circuit 100 outputs a sine wave having a constant amplitude and a phase and frequency equal to the phase and frequency of the signal applied to its input. The output of the compressor 100 is applied to a conventional mixer 102 which may be a "Four Quadrant Analog Multiplier" sold by Analog Devices as model number AD633. The mixer 102 also receives the output of a second compressor 104 which, in turn, receives its input from the band-pass output of the state variable filter 42. As explained above, the state variable filter 42 receives its input from the oscillator 22. The output of the compressor 104 thus has a phase and frequency that is the same as the phase and frequency of the signal applied to the electro-acoustic system through connector 52. The mixer 102 thus compares the phase of the stimulus signal with the phase of the source signal and outputs a voltage indicative thereof. The mixer 102 also outputs a number of higher frequency components which are attenuated by a conventional low-pass filter 108. The output of the low-pass filter 108 is thus a DC voltage indicative of the difference in phase between the stimulus signal and the analysis source signal. However, it may be offset by a DC voltage applied to the mixer 102 from the microprocessor 12 through the digital-to-analog converter 30 and the output multiplexer 32 for reasons that will be explained below. This phase indicative analog signal is applied to the analog to digital converter 80 through the input multiplexer 82 so that microprocessor 12 can determine the phase shift through the electro-acoustic system 91.

The output of the low-pass filter 108 is also applied to a conventional servo circuit 110 that outputs an analog signal indicative of the change in phase as a function of frequency. Although the servo circuit 110 does not receive any input indicative of frequency, it is able to determine the change in phase as a function of frequency using a simple time differentiator circuit because the frequency of the stimulus signal changes at a known rate. The output of the servo circuit 100 is thus an analog signal indicative of group delay. This group delay signal is also applied to the multiplexer 12 through the analog-to-digital converter 80 and the input multiplexer 82.

A final analysis source signal may be applied to the analysis subsystem 10 through a second acoustic input terminal 120 which is adapted to receive the output of a microphone (not shown). The terminal 120 is connected to another variable gain circuit 122 through a preamplifier 124 in the same manner that the variable gain circuit 64 receives the signals from terminal 60 through the preamplifier. The output of the variable gain circuit 122 is applied to the state variable filter 42 through the summer 40.

The final subsystem of the analyzer system 10 is the display subsystem. The display subsystem includes a conventional plasma display 130 having a 128×64 pixel array. The display 13.0 receives appropriate signals from a conventional display driver 132 to display either graphs or alpha numeric characters. The display subsystem also includes a number of indicator lights 134 marked with appropriate legends which receive their drive signals from a conventional transistor array 136.

The operation of the analysis system 10 of FIG. 1 will now be explained with reference to the flow chart of FIG. 2 and the schematics of FIGS. 3–6 showing the components of the system of FIG. 1 that are used for each of several tests.

Figure 2:
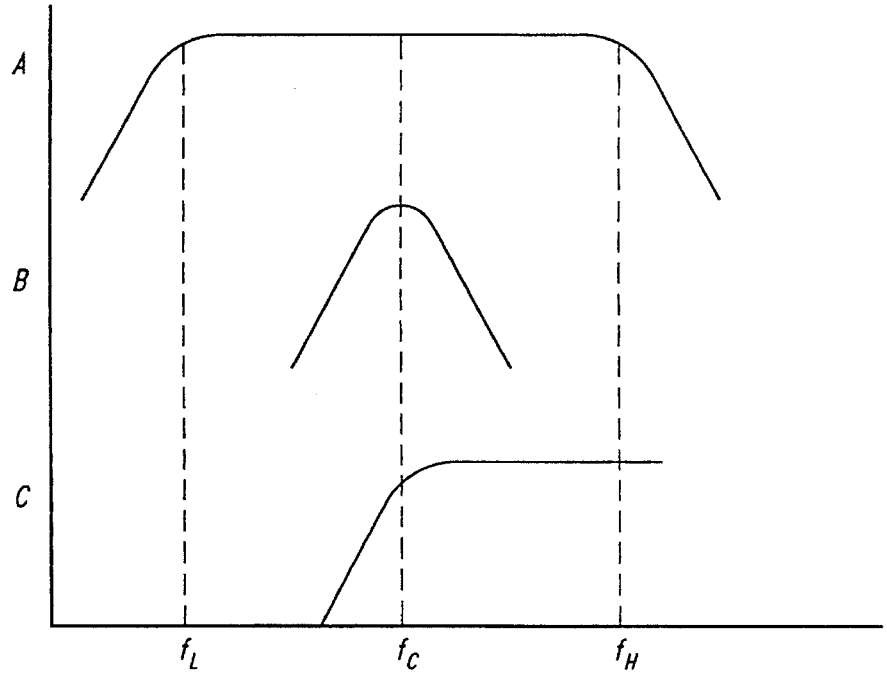
FIGS. 2A–2C are frequency response graphs of the electro-acoustic system and of filters used to determine the high cutoff frequency of the electro-acoustic system.
Figure 3:
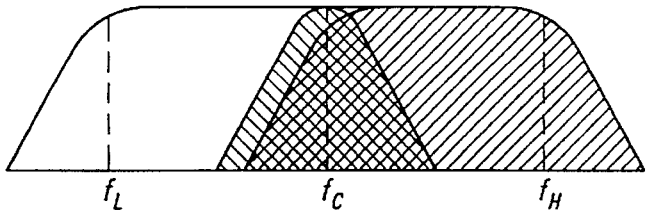
FIG. 3 is a graph showing the relationship between the frequency response of the electro-acoustic system and the filter frequency response graphs of FIG. 2 shown at a mid-frequency of the electro-acoustic system's bandwidth.

The manner in which the inventive analysis system for electro-acoustic systems is able to determine the bandwidth of the electro-acoustic system as illustrated with first reference to FIG. 2. By way of example, waveform A depicts the frequency response of the electro-acoustic system in which the low frequency cutoff (i.e., 3 dB down) is at a frequency $f_L$ and the high frequency cutoff (i.e., 3 dB down) is at a frequency $f_H$. The transfer function of the state variable filter 70 from the input to the band-pass output is shown in graph B, while the transfer function of the state variable filter 70 from the input to the high-pass output is shown in graph C. The pass band of the band-pass filter and the cutoff frequency of the high-pass filter are both set to the same frequency $f_C$. The filter waveforms B and C can be correlated with the transfer function of the electro-acoustic system in order to determine the high frequency cutoff of the electro-acoustic system. With reference to FIG. 3, the waveforms B and C are shown correlated with the transfer function of the electro-acoustic system at a filter frequency of $f_C$ that is between the low cutoff frequency $f_L$ and the high cutoff frequency $f_H$. Under these circumstances, the correlation of the electro-acoustic system transfer function with the transfer function of the band-pass filter corresponds to the area beneath the band-pass filter transfer function. The correlation between the electro-acoustic transfer function and the high-pass filter transfer function corresponds to the area of overlap between the electro-acoustic transfer function and the high-pass filter transfer function. Where the operating frequency $f_C$ of the state variable filter 70 is less than the high frequency cutoff $f_H$ of the electro-acoustic system, the energy of the correlated high-pass filter transfer function will be greater than the energy in the correlated low-pass filter transfer function.

Figure 4:
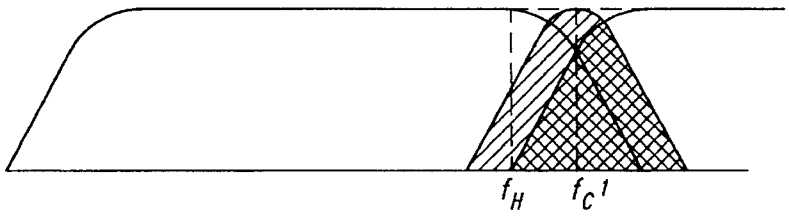
FIG. 4 is a graph showing the relationship between the frequency response of the electro-acoustic system and the filter frequency response graphs of FIG. 2 shown above the high frequency cutoff of the electro-acoustic system.

The state variable filter 70 transfer functions are shown correlated with the electro-acoustic system transfer function at a filter frequency $f_C^1$ above the high frequency cutoff frequency $f_H$ in FIG. 4. Under these circumstances, the area in which the band-pass transfer function overlaps the electro-acoustic system transfer function is greater than the area in which the high-pass filter transfer function overlaps the electro-acoustic system transfer function. The area of overlap of the band-pass filter transfer function is greater than the area of the overlap of the high-pass filter transfer function because the band-pass filter transfer function peaks at $f_C^l$, while the high-pass filter transfer function is already 3 dB down at $f_C^1$. Thus, when the operating frequency of the state variable filter 70 $f_C^1$ is greater than the high cutoff frequency $f_H$ of the electro-acoustic system transfer function, the energy from the band-pass filter output of the filter 70 is greater than the energy from the high-pass output of the filter 42.

Figure 5:
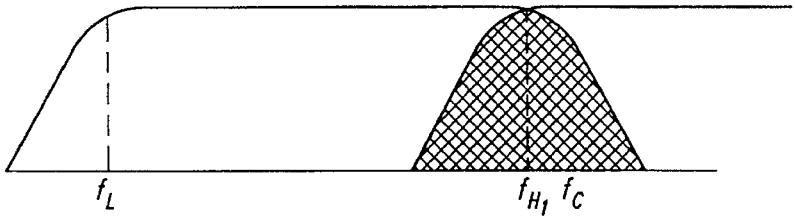
FIG. 5 is a graph showing the relationship between the frequency response of the electro-acoustic system and the filter frequency response graphs of FIG. 2 shown at the high frequency cutoff of the electro-acoustic system.

The operating frequency of the state variable filter 70 is shown at the high frequency cutoff $f_H$ of the electro-acoustic system in FIG. 5. Under these circumstances, the area that the band-pass filter transfer function overlaps the electro-acoustic transfer function is equal to the area that the high-pass filter transfer function overlaps the electro-acoustic transfer function. Thus, when the operating frequency of the state variable filter 70 is below the high frequency cutoff of the electro-acoustic system (FIG. 3), the accumulated energy from the high-pass output of the filter 70 will be greater than the accumulated energy from the band-pass output. When the operating frequency of the filter 70 is greater than the high frequency cutoff of the electro-acoustic system (FIG. 4), the accumulated energy from the band-pass output of the filter 70 will be greater than the accumulated energy from the high-pass output of the filter 70. When the operating frequency of the state variable filter 70 is equal to the high frequency cutoff of the electro-acoustic system (FIG. 5), the accumulated energy from the band-pass output of the filter 70 will be equal to the accumulated energy from the high-pass output of the filter 70.

A similar technique can be used to detect the low frequency cutoff of the electro-acoustic system. Specifically, when the operating frequency $f_C$ of the state variable filter 70 is above the low frequency cutoff $f_L$ of the electro-acoustic system, the accumulated energy from the low-pass output of the filter 70 will be greater than the accumulated energy from the band-pass output of the filter 70. When the operating frequency $f_C$ of the filter 70 is lower than the low frequency cut-off $f_L$ of the electro-acoustic system, the accumulated energy from the band-pass output of the filter 70 will be greater than the accumulated energy from the low-pass output of the filter 70. When the operating frequency $f_C$ of the filter 70 is equal to the low frequency cut-off $f_L$, the accumulated energy from the band-pass output of the filter 70 will be equal to the accumulated energy from the low-pass output of the filter 70.

Figure 6:
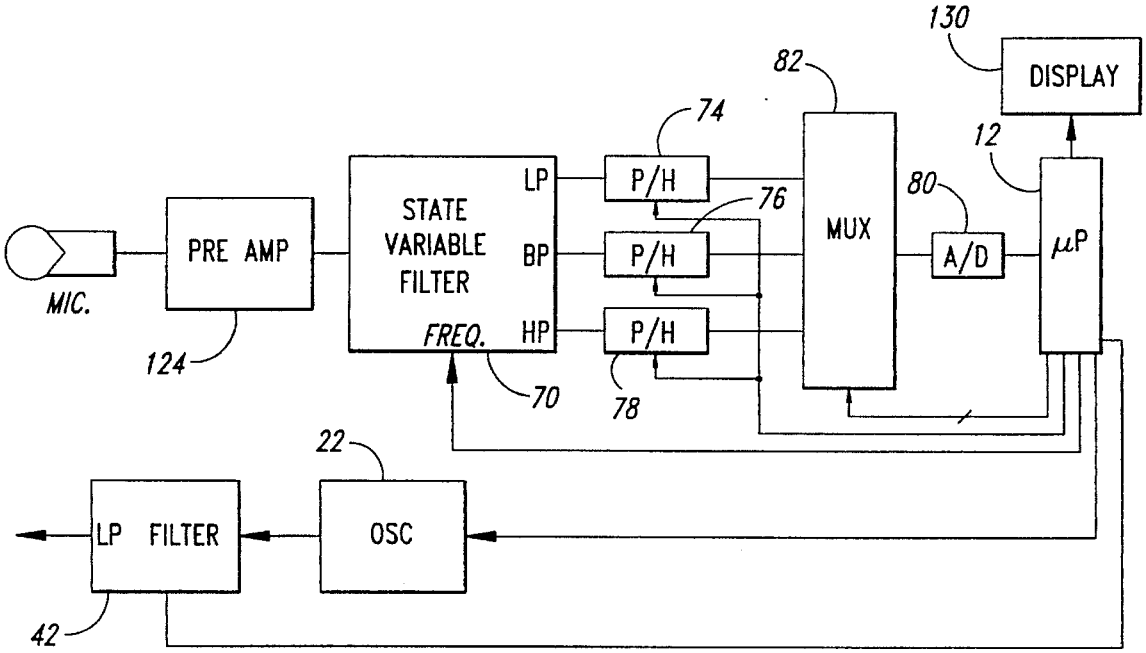
FIG. 6 is a block diagram of the components of the block diagram of FIG. 1 that are used to analyze the bandwidth of an electro-acoustic system.

The manner in which the analysis system 10 determines the bandwidth of the electro-acoustic system will now be explained with reference to FIG. 6 showing the major components of the system 10 that are used to determine bandwidth. The microprocessor 12 initially sets the operating frequency of the state variable filter 70 above the expected high frequency cutoff of the electro-acoustic system. The filter 42 is also set by the microprocessor 12 at a frequency above the expected high frequency cutoff of the electro-acoustic system so that the stimulus signal will pass through the filter 42. The microprocessor 12 then causes the oscillator 12 to sweep over the expected bandwidth of the electro-acoustic system, preferably from a relatively high frequency to a relatively low frequency.

It is highly preferred that the oscillator 22 be swept so that it spends the same amount of time at each frequency so that the spectrum of the swept signal is uniform. Although the oscillator 22 may be swept continuously, it is preferably swept by incremental changes in the oscillation frequency. Under these circumstances, the oscillator 22 preferably changes frequency at a 0 crossing point of the oscillator output signal. Otherwise, the discontinuities in the oscillator output signal will generate high frequency harmonics that will affect the accuracy of the bandwidth measurement.

The system can determine either the high frequency cutoff or the low frequency cut-off first. Assuming that the high frequency cutoff is to be determined first, the peak amplitudes of the respective signals of the high-pass and band-pass outputs of the filter 70 are periodically determined as the oscillator 22 sweeps over the frequency spectrum. Each of these peak values are applied to the microprocessor 12 through the multiplexer 82 and analog to digital converter 80. The values are accumulated in internal memory in the microprocessor 12, such as by maintaining a running total of the amplitude of each filter output. After the oscillator 22 has been swept over the entire frequency range, the microprocessor determines whether the accumulated values for the high-pass filter are greater or less than the accumulated values for the band-pass filter. If the accumulated high-pass values are less than the accumulated band-pass values, the operating frequency of the state variable filter 70 is reduced and the oscillator 22 made to sweep over the frequency range again while the signals at the high-pass and band-pass outputs of the filter 70 are accumulated. A comparison is once again made between the accumulated high-pass filter values and the accumulated band-pass filter values. The microprocessor 12 continues to reduce the operating frequency of the state variable filter 70 until the accumulated band-pass filter values become less than the accumulated high-pass filter values. The operating frequency of the state variable filter 70 at which this occurs is then determined to be the high frequency cutoff of the electro-acoustic system.

The low frequency cutoff of the electro-acoustic system is determined in a similar manner. The microprocessor 12 first sets the operating frequency of the state variable filter 70 to a frequency well above the expected low frequency cutoff of the electro-acoustic system and then sweeps the oscillator 22 from well above the expected low frequency cutoff of the electro-acoustic system to below the expected low frequency cutoff of the electro-acoustic system. During the sweep of the oscillator output signal, the peak values at the band-pass and low-pass outputs of the filter 70 are periodically sampled and applied by the multiplexers 82 and A/D converter 80 to the microprocessor 12 where the samples are accumulated. At the end of the sweep of the oscillator output signal, the microprocessor determines whether the accumulated band-pass filter values are greater or lesser than the accumulated low-pass filter values. If the accumulated low-pass filter values are less than the accumulated band-pass filter values, then the operating frequency of the state variable filter 70 is decreased and another sweep of the oscillator 22 occurs. The operating frequency of the state variable filter 70 is repeatedly reduced after each sweep of the oscillator 22 until the state variable filter 70 reaches an operating frequency at which the accumulated band-pass filter values become larger than the accumulated low-pass filter values. The state variable operating frequency at which this occurs is determined to be the low frequency cutoff of the electro-acoustic system. The microprocessor 12 then causes the display 130 to display either the numerical of the CUTOFF frequencies or else a graph of the transfer function of the electro-acoustic system.

Figure 7:
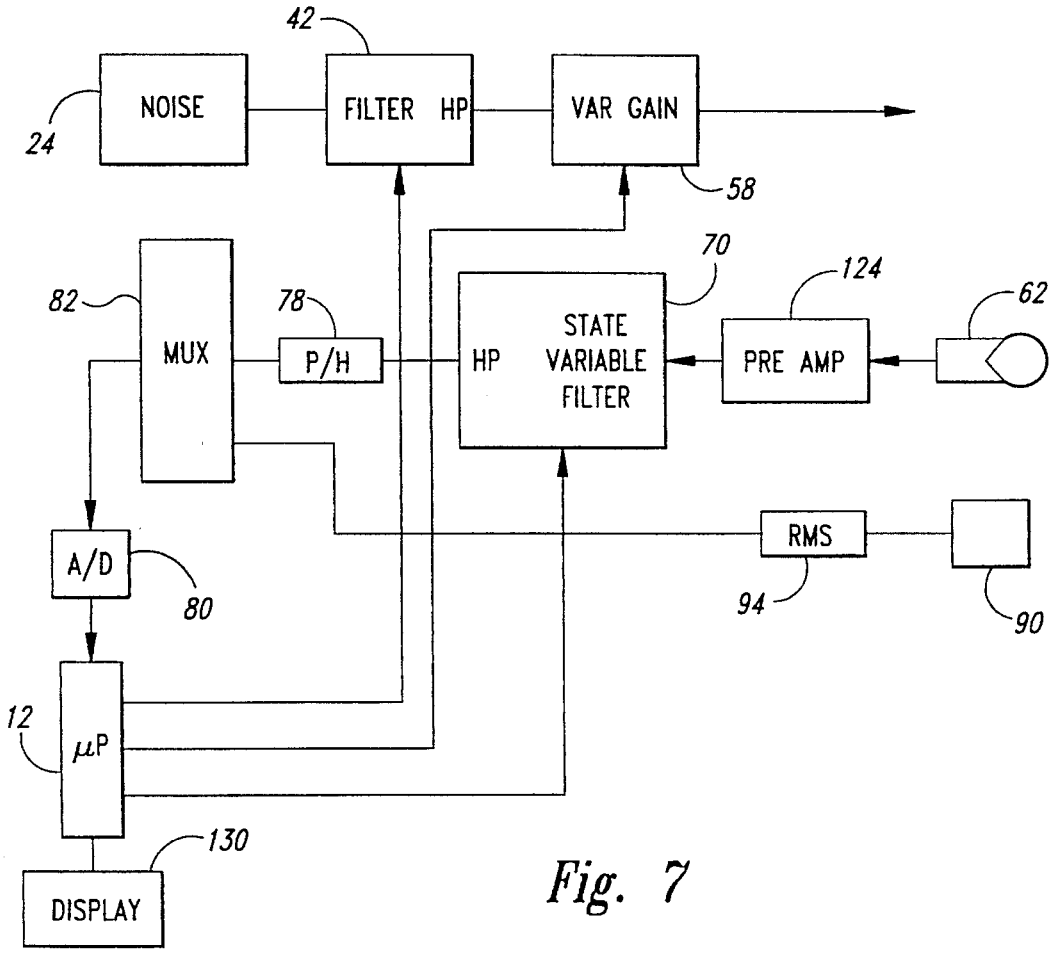
FIG. 7 is a block diagram of the components of the block diagram of FIG. 1 that are used to analyze the thermal limit and related parameters of an electro-acoustic system.

The manner in which the analysis system 10 determines the thermal limit of the electro-acoustic system will now be explained with reference to FIG. 7 which shows the essential components of the analysis system 10 that are used to determine the thermal limit. The stimulus signal applied to the electro-acoustic signal is a random noise signal generated by the random noise generator 24. The noise signal is high-pass filtered by the state variable filter 42 set to a frequency above the low frequency cutoff of the electro-acoustic system to avoid delivering excessive power to the acoustic transducer below the low frequency cutoff of the transducer. The high-pass output of the filter 42 is then applied to the electronic input of the electro-acoustic system through another variable gain circuit 58. The gain of the variable gain circuit 58 is controlled by the microprocessor 12.

In analyzing the thermal limit of an electro-acoustic system, two analysis signals are used. A first analysis signal is applied to the system through the power input terminals 90 from the terminals of the acoustic transducer. This power input signal is applied to the RMS converter 94 which outputs an analog signal indicative of the RMS power of the signal delivered to the acoustic transducer.

The second analysis signal for analyzing the thermal limit of the electro-acoustic system is the output of the microphone 62 which picks up the acoustic signal generated by the acoustic transducer. The microphone output signal, after being amplified by the preamplifier 124, is applied to the state variable filter 70. The microprocessor 12 sets the operating frequency of the state variable filter 70 at the low frequency cutoff of the electro-acoustic system. As a result, the signal at the high-pass output of the filter 70 encompasses the entire band-width of the electro-acoustic system. The high-pass output is applied to the peak hold circuit 78 which generates an analog signal indicative of the peak amplitude of the signal at the high-pass output of the filter 70. The output of the peak hold circuit 78, as well as the output of the RMS circuit 94, is applied to the microprocessor 12 through the multiplexer 82 and the analog to digital converter 80.

In operation, the microprocessor 12 gradually increases the gain of the noise signal output by the variable gain circuit 58 so that the amplitude of the noise signal applied to the electro-acoustic system gradually increases. The resulting increases in the electrical signal applied to the electro-acoustic system, as well as the amplitude of the resulting acoustic signal generated by the acoustic transducer, are monitored by the microprocessor 12. During the period where relatively low level power is applied to the acoustic transducer, the analysis signals will track the amplitude of the noise signal so that there will be a linear relationship between the amplitude of the noise signal stimulus and the amplitude of the analysis sources. However, when the thermal limit of the acoustic transducer is reached, the acoustic signal picked up by the microphone 62 will no longer track either the noise signal applied to the input of the electro-acoustic system or the power signal applied to the RMS converter 94. When this occurs, the thermal limit of the acoustic transducer has been reached. The microprocessor 12 then determines the power level of the acoustic transducer's thermal limit from the output of the RMS circuit 94. The analysis system 10 thus determines the true value of the power that the acoustic transducer is capable of handling without performance degradation, and this value is typically far less than the amount of power that the acoustic transducer is capable of handling without being damaged.

After the thermal limit has been determined, the thermal mass of the system may also be determined. The thermal mass of the system is related to how quickly the acoustic transducer is heated beyond its thermal limit. An acoustic transducer requiring more time to reach its thermal limit has a greater thermal mass. The thermal mass is obtained by decreasing the gain of variable gain circuit 58 to allow the acoustic transducer to cool. After a sufficient cooling period has elapsed, the variable gain circuit 58 is set by the microprocessor 12 to the same gain to which it was set when the thermal limit occurred. The acoustic signal picked up by the microphone 62 is then monitored along with the elapsed time from the rapid increase in the amplitude of the noise signal. The elapsed time at which the output of the microphone 62 falls 3 dB is used to calculate the thermal mass of the acoustic transducer by a known formula.

Figure 8:
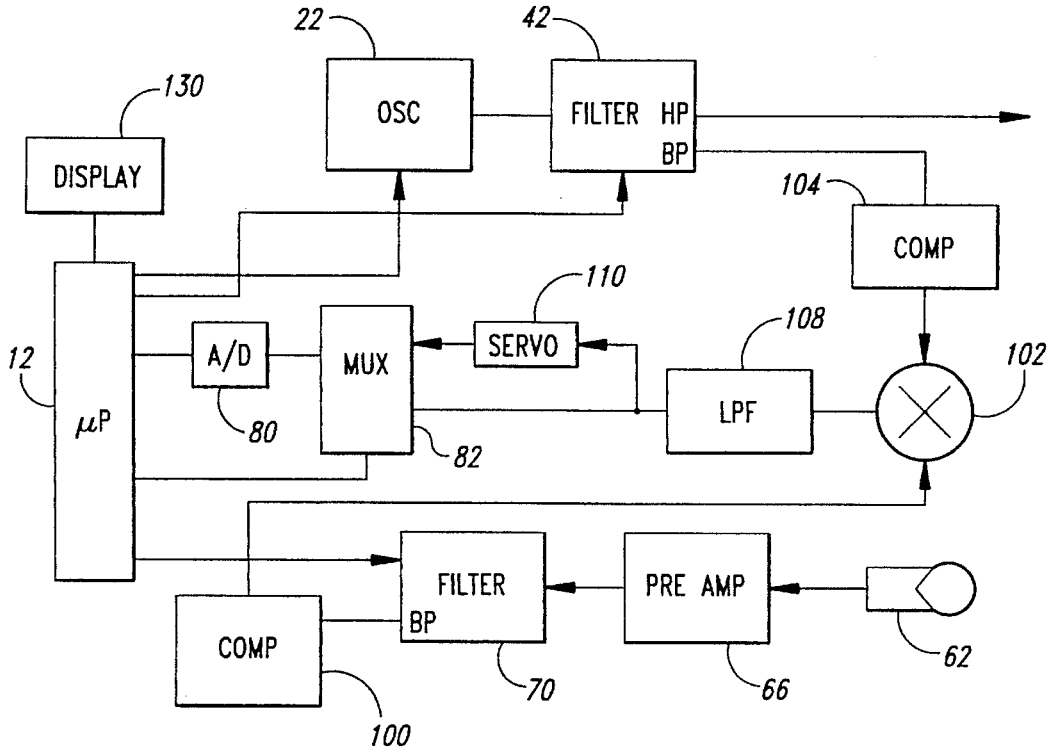
FIG. 8 is a block diagram of the components of the block diagram of FIG. 1 that are used to analyze the group delay of an electro-acoustic system.

The portion of the analysis system 10 that is used to determine phase shift and group delay is illustrated in FIG. 8. Basically, the purpose of the phase shift and group delay analysis is to determine and display the phase shift from the electrical input to the electro-acoustic system to its acoustic output as a function of the frequency of the electrical stimulus applied to the electro-acoustic system. The microprocessor 12 applies appropriate control signals to the oscillator 22 and the state variable filter 42 to cause the oscillator 22 and filter 42 to sweep at the same frequency from one end of the frequency spectrum to the other. The high-pass output of the filter 42 is applied to the electrical input of the electro-acoustic system so that the electro-acoustic system receives a swept sign wave. The band-pass output of the state variable filter 42 is applied to the compressor 104 to cause the compressor 104 to generate a fixed amplitude sign wave having a phase and frequency equal to the phase and frequency of the stimulus signal applied to the electro-acoustic system.

The resulting acoustic signal is picked up by the microphone 62, and after being amplified by the preamplifier 66, as applied to the input of the state variable filter 70. The operating frequency of the state variable filter 70 is controlled so that it is at all times equal to the operating frequency of the state variable filter 42. As a result, the state variable filter 70 is swept along with the oscillator 22 and state variable filter 42. The band-pass output of the filter 70 is applied to the second compressor 100 which thus generates a constant amplitude sine wave having a phase and frequency equal to the phase and frequency of the acoustic signal picked up by the microphone 62. The sine wave from the comparator 100 is applied to the mixer 102 along with the sine wave of the compressor 104 which has a phase and frequency equal to the phase and frequency of the stimulus signal. The output of the mixer 102 thus has a DC level indicative of the phase shift through the electro-acoustic system as well as higher frequency mixing products of the sine wave signals applied to its inputs. These higher frequency mixing products are removed by the low-pass filter 108, thus leaving a DC signal indicative of phase shift as essentially the only component of the signal at the output of the low-pass filter 108. This phase indicative signal is applied to the microprocessor 12 through the input multiplexer 82 and the analog-to-distal converter 80. The phase indicative signal at the output of the low-pass filter 108 is also applied to the servo circuit 110 which outputs a signal indicative of the derivative of phase with respect to frequency. As mentioned above, although the servo circuit 110 does not receive any input indicative of frequency, it can determine the change in phase as a function of frequency with a simple time based differential circuit since the microprocessor 12 sweeps the oscillator 22 and filters 42, 70 at a known rate.

As the microprocessor 12 sweeps the frequency of the oscillator 22 and filters 42, 70, it records the phase shift and group delay at each of a plurality of frequencies. The microprocessor 12 then applies appropriate signals to the display 130 to create a graph of the magnitude of phase shift and group delay as a function of frequency. As is well known in the art, a graph of this nature allows one skilled in the art to determine if an amplitude reduction at a particular frequency is produced by a null that cannot be eliminated through equalization or if it is produced by a dip that can be eliminated through equalization.

Figure 9:
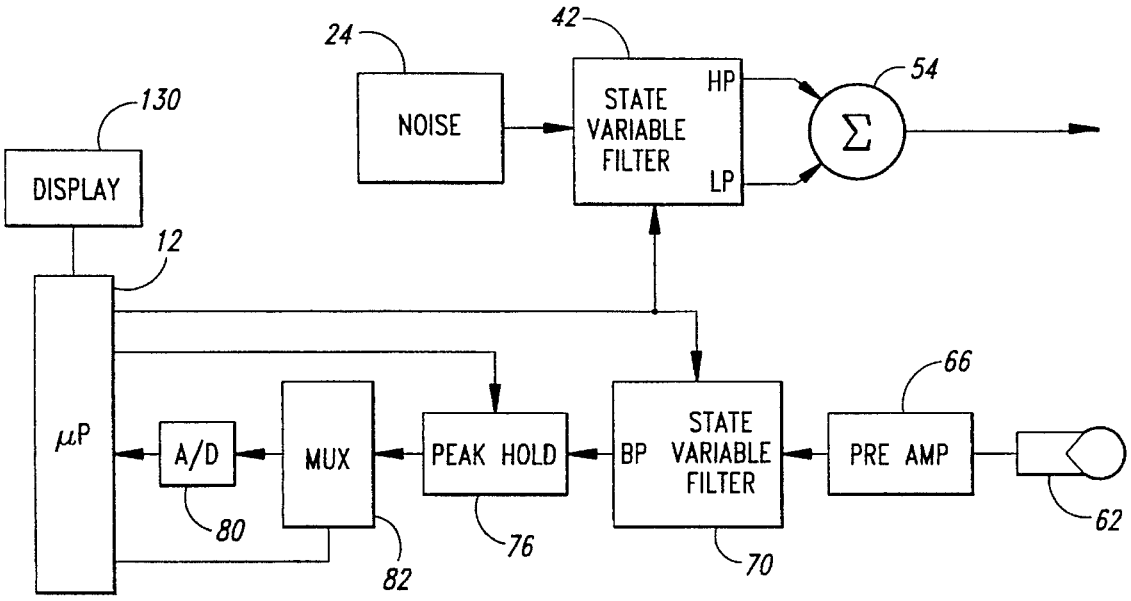
FIG. 9 is a block diagram of the components of the block diagram of FIG. 1 that are used to analyze the spurious vibration of an electro-acoustic system and the environment in which it is installed.

The components of the analysis system 10 that are used to analyze the spurious vibration of the electro-acoustic system or its surrounding environment will now be explained with reference to FIG. 9. The source of the stimulus signal for the spurious vibration analysis is the random noise signal output by the noise generator 24 which is applied to the input of the state variable filter 42. The high-pass and low-pass outputs of the state variable filter 42 are combined in the summer 54, and the resulting output is applied to the electrical inputs of the state variable filter 70. The stimulus signal thus consists of all of the .frequency components of the random noise signal produced by the random noise generator 24 except a small band of frequencies centered at the operating frequency of the filter 42.

The resulting acoustic signal is picked up by the microphone 62, amplified by the preamplifier 66 and applied to the input of the state variable filter 70. The band-pass output of the state variable filter is the only output of the state variable filter 70 that is used. The state variable filter 70 operates at a frequency that is set by the same control signal used to control the operating frequency of the state variable filter 42. Thus, the band-pass output of the state variable filter 70 contains the same frequency components that are excluded from the output of the summer 54. The amplitude of the noise signals at the band-pass output of the filter 70 are periodically sampled by a peak hold circuit 76 and applied to the microprocessor 12 through the multiplexer 82 and analog-to-distal converter 80.

In operation, the microprocessor 12 scans the operating frequency of the state variable filters 42, 70 over the bandwidth of the electro-acoustic system. The microphone 62 picks up not only the acoustic signal resulting from the electrical signal output by the summer 54, but it also picks up spurious noise generated by the electro-acoustic system or objects in the environment of the electro-acoustic system. The analysis system is able to determine which of the signals picked up by the microphone 62 are spurious, because the spurious signals will have frequency components that are not present in the stimulus signal applied to the electrical inputs of the electro-acoustic system. For example, if the band-pass of the state variable filter 42 is centered at 1 kilohertz, the acoustic signal generated by the acoustic transducer will consist of random noise at all frequencies except in the range of 1 kilohertz. Thus, any 1 kilohertz frequency components picked up by the microphone 62 must be generated by objects that are driven to vibrate at that frequency by other frequency components of the acoustic signal. In this manner, the state variable filters 42, 70 scan the frequency spectrum to determine if spurious vibrations are produced at any frequency in the band-width of the electro-acoustic system. The microprocessor 12 records the peak amplitude values output by the peak hold circuit 76 and the corresponding frequency at which the sample is taken. After the entire band-width has been sampled, the microprocessor 12 plots a graph on the display 130 of the amplitude of the spurious vibrations as a function of frequency.

The preferred embodiment of the portion of the analysis system that determines spurious vibration applies a broad band noise signal to the electro-acoustic system and examines a narrow band of acoustic signals. It will be understood, however, that the analysis system may alternatively apply a narrow band swept frequency stimulus to the electro-acoustic system and examine a broad band of acoustic signal of all frequencies except the narrow band frequency components of the stimulus. In this case, the band-pass output of the state variable filter 42 would be applied to the electro-acoustic system, and the high-pass and low-pass outputs of the state variable filter would be summed with the summer 54 and applied to the peak hold circuit 76.

Figure 10:
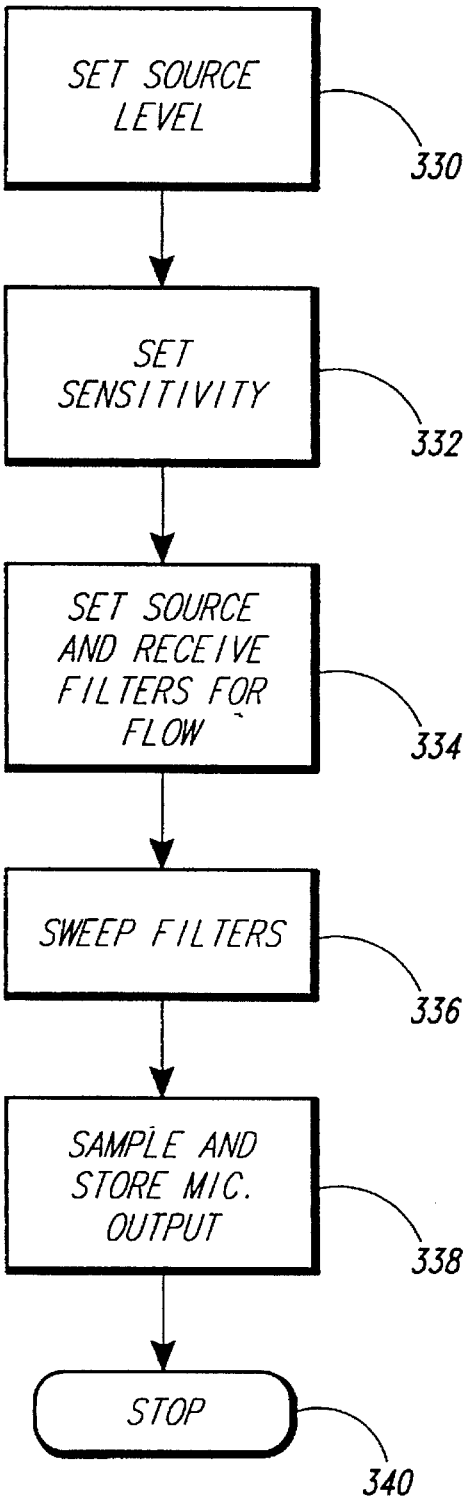
FIG. 10 is a flow chart showing the presently preferred embodiment of software executed by a microprocessor in the analysis system of FIG. 1.

As explained above, the microprocessor 12 is programmed to analyze the performance parameters of the electro-acoustic system. The presently preferred software for programming the microprocessor 12 will now be explained with reference to the flow chart of FIG. 10. The program is entered at step 200 where all of the stimulus signal sources, i.e., the oscillator 22 and the noise generator 24 are turned off by the microprocessor 12 generating appropriate control signals as explained above with reference to FIG. 1. The state variable filter 70 is then set to 2 kilohertz at step 202, and the gain of the preamplifiers 66, 124 are set to their mid-range at step 204.

The program then goes through a series of steps to properly set the amplitude of the source signal and the gain of the analyzer circuits. Specifically, at steps 206 the microprocessor 12 samples the high-pass output of the filter 70 through the peak hold circuit 78, multiplexer 82, and A/D converter 80 to determine if a signal is present. If not, the microprocessor 12 samples the low-pass output of the filter 70 at step 208 in the same manner. If there is no signal present at the high-pass output of the filter 70, but there is a signal present at the low-pass output of the filter 70 as detected at 206, 208, the microprocessor 12 increments the operating frequency of the state variable filter 70 at step 210, thereby approaching parity with the ambient noise level in the low in high frequency bands of the filter 70. The program then branches back to step 206 to check for an ambient level at the high-pass output of the filter 70.

If the program determines at steps 206, 208 that an ambient level is not on either the low-pass output of the filter 70 or the high-pass output of the filter 70, the microprocessor 12 increases the gain of the preamplifiers 66, 124 at step 212, and the program once again returns to 206 to check for an ambient level on the high-pass output of the filter 70. Once an ambient level signal is detected on the high-pass output of the filter 70, the program branches from step 206 to step 214, where the current gain value of the preamplifier 66, 124 are stored. The stored values of the preamplifier gains are used as the noise threshold for setting the preamplifier gain in performing the analysis of the electro-acoustic system. Similarly, the current setting of the state variable filters 42, 70 is stored at step 216. In step 220, the gain of the preamplifiers 66, 124 are increased at 20 dB above their ambient levels stored at 214. The filters 42, 70 are then swept over the expected band-width of the electro-acoustic system at 1/12 of an octave intervals and the band-pass output of the filters are sampled as described above in step 222. The samples of the band-pass filter are then stored in internal memory in the microprocessor 12 at step 224 as ambient sound level at each frequency.

After the analyzer system 10 has been set up in steps 206–224, the analysis system 10 analyzes the bandwidth of the electro-acoustic system. The state variable filters 42, 70 are set to 10 kilohertz at step 230. The microprocessor 12 then sweeps the frequency of the oscillator 22 from one octave below the operating frequency of the filters 42, 70 to one octave above the operating frequency of the filters 42, 70 at step 232. The microprocessor 12 causes the oscillator 22 to sweep so that the amount of time at the oscillator 22 operates at all frequencies is constant. As a result, the frequency spectrum of the stimulus signal output at the terminal 52 is of constant amplitude over the sweep range. In step 234, the microprocessor periodically samples the low-pass output, high-pass output and band-pass output of the filter 70 during the sweep of the oscillator 22 and then averages all of those output samples. The average of the high-pass output samples are compared to the average of the band-pass samples at step 236. It is assumed that the initial filter operating frequency of 10 kilohertz is above the high frequency cutoff of the acoustic transducer being tested. Thus, during the first pass through step 236, the average of the high-pass outputs will be less than the average of the band-pass outputs, thus causing the program to branch to step 238 where the operating frequency of the filter 70 is lowered by 1/48 of an octave. Steps 232–238 are continuously repeated until the program detects at step 236 that the average high-pass filter output has become greater than the average band-pass filter output. The program then branches to step 240 to set the high frequency cutoff at the current operating frequency of the filter 70. The operating frequency of the filter 70 is then lowered at step 242 in preparation for determining the low frequency bandwidth of the electro-acoustic system.

The program begins to analyze the low frequency bandwidth of the electro-acoustic system at step 250 in the same manner as in step 232. Once again, in the same manner as in step 234, the program in step 252 samples the low-pass output, the high-pass output and the band-pass output of the filter 70 and averages those samples. The average of the band-pass outputs is then compared to the average of the low-pass outputs at step 254. Since the operating frequency of the filter 70 is initially well above the low frequency cutoff of the electro-acoustic system, the average of the low-pass outputs will be greater than the average of the band-pass outputs. The program will thus branch to step 256 to determine if the operating frequency of the filter 70 has been decremented to 40 Hz. Step 256 is performed to provide a definitive end point for the operating frequency of the filter 70. In normal operation, the low frequency cutoff of the electro-acoustic system, will be reached before 40 Hz so that the program will normally branch to step 258 where the operating frequency of the filter 70 is lowered by 1/48 of an octave. Steps 250–258 are continuously repeated until the program determines at 254 that the average of the low-pass outputs of the filter 70 have become less than the average of the band-pass outputs of the filter 70. The program will then branch to 260 to set the low frequency cutoff of the electro-acoustic system at the operating frequency of the filter 70. At this point, the microprocessor has determined the low and high cutoff frequencies of the electro-acoustic system. By recording the average of the band-pass filters at each operating frequency of the filter 70, the microprocessor is able to also display a heavily smoothed frequency response of the electro-acoustic system between the low and high cutoff frequencies. The program then goes on to analyze the thermal limits of the electro-acoustic system.

As mentioned above, the stimulus signal for the frequency response test may be a broad band noise signal instead of a swept sine wave. In this case, the microprocessor 12 energizes the noise generator 24, sets the frequency of the oscillator 48 to below the expected low cutoff frequency of the electro-acoustic system, and sets the variable gain circuit 58 at the proper level. The oscillator 72 for the filter 70 is then swept over the frequency range of interest while the microprocessor 12 accumulates data at each of many frequencies. This data is then processed as described above.

The portion of the program analyzing the thermal limit of the electro-acoustic system is entered at step 270, where the source filter 42 is set to the low frequency limit of the lowest acoustic transducer in the electro-acoustic system. By setting the source filter 42 to the low cutoff frequency of the electro-acoustic system, excessive energy will not be applied to the acoustic transducer at a frequency below which it is able to dissipate mechanically. The receive filter is then set to the approximate spectral center of the bandwidth of the acoustic transducer at step 272. This frequency will normally be at the frequency where the low-pass output of the state variable filter 70 is equal to the amplitude of the high-pass output of the state variable filter 70 when a broad band noise signal is applied to the electro-acoustic system. The microprocessor 12 sets the output level of the source to –40 dB by adjusting the variable gain circuit 58 that receives the noise signal from the high-pass output of the source state variable filter 42. This procedure is accomplished at step 274. The microprocessor 12 then reads the input level of the microphone 62 at step 276 by sampling the low-pass output of the peak hold circuit 74. At step 278, the microprocessor 12 determines if the amplitude of the microphone input level has continued to track the amplitude of the stimulus signal. In other words, if the source output level increases by one dB and the microphone input level does not rise by a corresponding one dB, an "alpha limit" has been reached as determined at step 278. However, the alpha limit will normally not be reached until many passes through step 278. The program will thus initially branch to step 280 where the microprocessor 12 compares the high-pass output of the filter 70 to the low-pass of the filter 70. If, as the amplitude of the source signal increases, the signal at the high-pass output of the filter 70 increases relative to the amplitude of the signal of the low-pass output of the filter 70, then clipping of the source signal has occurred since the clipping of the low frequency signals will generate higher frequency harmonics. If clipping occurs before the alpha level has been reached, the program records the output level at which clipping occurred at step 282 and terminates the thermal limit test. If, as is normally the case, clipping does not occur, the program branches from 280 to step 284 where the amplitude of the source signal is increased by 1 dB.

The program loops through steps 276–284 until the power applied to the acoustic transducer causes it to heat sufficiently that its efficiency is reduced. At this point, increases in power applied to the acoustic transducer will no longer be matched by the same increase in the amplitude of the acoustic signal. At this point, the microprocessor 12 determines that the microphone input level is no longer tracking the amplitude of the source signal and thus branches from step 278 to step 288. At step 288, the microprocessor 12 samples the output of the RMS circuit 94, which is coupled to the terminals of the acoustic transducer in order to determine the power being applied to the acoustic transducer at its thermal limit. The program then branches to step 290 to determine the thermal mass of the acoustic transducer. At step 290, the microprocessor 12 outputs a new gain signal to the variable gain circuit 58 for 30 seconds to allow the acoustic transducer to cool. The microprocessor 12 then restores the variable gain circuit 58 to the level of gain when the thermal limit was reached at step 292. Since high power is now being applied to the acoustic transducer, its temperature increases eventually to the point where its efficiency is reduced. During this time, the band-pass output of the filter 70 is sampled every 100 milliseconds for 40 seconds at step 294. Whenever the amplitude of the signal at the band-pass output of the filter 70 is reduced by a predetermined magnitude (e.g., 3 dB) the test terminates at step 296, and the samples recorded at step 294 are saved to allow the microprocessor 12 to determine the thermal mass of the acoustic transducer as well as its thermal signature (i.e., change in efficiency from thermal heating as a function of time). The program then progresses to step 300 to start the analysis of phase shift and group delay through the electro-acoustic system.

The gain of the preamplifier 66 is set at step 300 to an appropriate value, and the end points between which the sweep of the oscillator 22 will occur are set at step 302 as the spectral center of the acoustic transducer plus and minus one octave. The send state variable filter 42 and the receive state variable filter 70 are also set to the spectral center of the acoustic transducer at step 304 and the quality factor "Q" for the filters 42, 70 are set to a relatively high value, e.g., 10, at step 306. The microprocessor then starts a sweep of the oscillator 22 at step 308 between the end points set at step 302. During the sweep, the amplitude of the signal at the band-pass output of the filter 70 is sampled by the microprocessor 12 through the peak hold circuit 76, multiplexer 82 and A/D converter 80 to provide a record of the frequency response of the electro-acoustic system. This is accomplished at step 310. At step 312, the microprocessor 12 determines the elapsed time from the oscillator 22 sweeping through the spectral center of send filter 42, and the receipt of that frequency as indicated by the peaking of the signal at the band-pass output of the filter 70. This elapsed time provides a measure of the phase shift due to the propagation time between the acoustic transducer and the microphone. In order to determine the true phase shift through the electro-acoustic system, the "excess phase" must be eliminated from future phase shift measurements.

The microprocessor 12 cancels out the effects of this excess phase by applying a time offset between the start of the send sweep and the start of the receiver sweep so that the output of the low-pass filter 108 is zero at the spectral center of the acoustic transducer. Once the "excess phase" has been determined, the microprocessor starts the sweep of the oscillator 22 at step 314. The oscillator 22 is swept at step 314 from the low frequency cutoff of the electro-acoustic system (as determined at step 260) to the high frequency cutoff of the electro-acoustic system (as determined at step 240). At step 316, the microprocessor 12 samples the output of the low-pass filter during the sweep and stores these values at step 318. The microprocessor 12 then receives and stores the output of the servo circuit 110 at step 320. At this point, the microprocessor has recorded the phase shift of the electro-acoustic system as a function of frequency as well as the group delay of the electro-acoustic system as a function of frequency. The microprocessor then calculates and stores the average change in phase for each incremental step in frequency of the oscillator at step 322. As explained below, this data is used to determine whether a null at a given frequency is correctable through equalization. The program compares the phase shift and group delay with the mean calculated at 322 in step 324. In the event that the dip amplitude is less than ¼ of the mean amplitude over the bandwidth of the electro-acoustic system, and the group delay is greater than four times the mean group delay at any frequency, the frequency is marked as unequalizable at step 324. An unequalizability magnitude is then calculated at step 326 as the ratio of the spectral amplitude value to the group delay at each frequency. A higher unequalizability magnitude is an indication that a relatively large group delay has occurred at a frequency even if the dip in frequency response is relatively small. Group delays having this characteristic in relation to the frequency response cannot be easily corrected through equalization. After the group delay analysis has occurred, the program progresses to step 330 to analyze the spurious vibration of the electro-acoustic system and its environment.

The microprocessor 12 sets the amplitude of the source at step 330 by applying an appropriate signal to the variable gain circuit 58. Similarly, the microprocessor 12 sets the sensitivity of the microphone output at step 332 by applying an appropriate signal to the preamplifier 66. The microprocessor 12 then sets the operating frequency of the source filter 42 and the operating frequency of the receive filter 70 at the low cutoff frequency of the electro-acoustic system at step 334. It will be recalled that this low cutoff frequency was determined in the bandwidth test at step 260. The microprocessor 12 then sweeps the filters 42, 70 to the high cutoff frequency of the electro-acoustic system at step 336, and the microprocessor 12 samples and stores the band-pass output of the receive filter 70 at step 338 to detect any frequency components that are not present in the signal at the outputs of the low-pass and high-pass outputs of the source filter 42. The program then terminates at 340 since all of the tests have been completed. Although not shown, the information obtained in the above tests can be displayed in a variety of formats, as is well known to one skilled in the art.

I claim:

1. A system for analyzing an electro-acoustic system of the type having an electronic input and an acoustic transducer generating an acoustic signal corresponding to an electrical signal applied to said electronic input, said system comprising:

a stimulus subsystem for generating said electrical signal, said stimulus subsystem including:

an oscillator generating an oscillator output signal having a primary frequency component determined by the value of an oscillator frequency control signal;

a noise generator generating a random noise signal at a noise generator output;

a band-reject filter attenuating frequency components of a signal applied to an input that are within a predetermined band of frequencies centered at a specified frequency corresponding to the value of a frequency control signal applied to a frequency control input, said band-reject filter input being coupled to said noise generator output and generating at an output a band-reject filtered signal;

a variable gain circuit having an input selectively coupled to said noise generator output and said band-reject filter output in response to a first coupling control signal, said variable gain circuit generating a signal at an output having a magnitude that is a product of said magnitude of a signal applied to its input and said value of a gain control signal applied to a gain control input;

coupling means responsive to a second coupling control signal for selectively coupling said oscillator output signal, said variable gain output, and said band-reject filter output to the electronic input of said electro-acoustic system;

an analysis subsystem for analyzing a plurality of performance parameters of said electro-acoustic system, said analysis subsystem including:

a microphone acoustically coupled to the acoustic transducer of said electro-acoustic system and generating an output signal corresponding to said acoustic signal;

a low-pass filter attenuating frequency components of a signal applied to an input that are greater than a specified frequency corresponding to the value of a frequency control signal applied to a frequency control input, said low-pass filter input being coupled to the output of said microphone and generating at an output a low-pass filtered signal;

a high-pass filter attenuating frequency components of a signal applied to an input that are less than a specified frequency corresponding to the value of a frequency control signal applied to a frequency control input, said high-pass filter input being coupled to the output of said microphone and generating at an output a high-pass filtered signal;

a band-pass filter attenuating frequency components of a signal applied to an input that are significantly greater than and less than a specified frequency corresponding to the value of a frequency control signal applied to a frequency control input, said band-pass filter input being coupled to the output of said microphone and generating at an output a band-pass filtered signal;

a first analog-to-digital converter having an input selectively coupled to the outputs of said low-pass filter, said high-pass filter, and said band-pass filter, said analog-to-digital generating at an output a digital word corresponding to the magnitude of a signal applied to its input;

a second analog-to-digital converter having an input coupled to said microphone said analog-to-distal converter generating at an output a digital word corresponding to the magnitude of a signal applied to its input; and a phase comparator receiving said oscillator output signal and said microphone output signal and providing a phase indication signal corresponding to the difference in phase between said oscillator output signal and said microphone output signal;

a control and display subsystem for controlling the operation of said stimulus and analysis subsystems and displaying the results of said analysis, said control and display subsystem including:

a display for providing a visual indication of the results of an analysis corresponding to analysis data; and a microprocessor coupled to said oscillator for generating said oscillator frequency control signal, said band-reject filter for generating the frequency control signal for said band-reject filter, said variable gain circuit for generating said gain control signal and said first coupling control signal, said coupling means for generating said second coupling control signal, said high-pass filter, low-pass filter, and band-pass filter for generating the frequency control signals for said high-pass filter, low-pass filter and band-pass filter, said first and second analog-to-digital converters for receiving respective digital words therefrom, and said display for generating said analysis data, said microprocessor: analyzing the bandwidth of said electro-acoustic system by:

generating a stimulus signal having a frequency spectrum that encompasses the bandwidth of said electro-acoustic system;

generating at least one of said coupling control signals for coupling either the output of said oscillator so the variable gain output to the electronic input of said electro-acoustic system;

generating a frequency control signal and applying said frequency control signal to the frequency control inputs of said high-pass, low-pass, and band-pass filters to cause said filters to have the same specified frequency and said specified frequency to sweep through at least a portion of said frequency spectrum while said stimulus signal is being applied to said electro-acoustic system;

recording the digital words from said first analog-to-digital converter corresponding to respective amplitudes of the signals output by said high-pass, low-pass, and band-pass filters to provide three sets of digital words each of which contain a record of the amplitudes of signals at the output of a respective filter at a plurality of specified frequencies;

accumulating the values of the distal words in each of said sets to provide a respective accumulated value for each of said high-pass, low-pass, and band-pass filters;

determining the high frequency response of said electro-acoustic system as the specified frequency at which the accumulated value for said band-pass filter is substantially equal to the accumulated value for said high-pass filter;

determining the low frequency response of said electro-acoustic system as the specified frequency at which the accumulated value for said band-pass filter is substantially equal to the accumulated value for said low-pass filter; and causing said display to provide a visual indication of said high frequency bandwidth and said low frequency bandwidth; and analyzing the thermal power limit of said electro-acoustic system by:

generating said first coupling control signal to cause the output of said noise generator to be applied to said variable gain circuit;

generating said second coupling control signal to couple said variable gain output to the electronic input of said electro-acoustic system;

generating said gain control signal to cause a noise signal at the output of said variable gain circuit to gradually increase in intensity;

receiving the digital words from said second analog-to-digital converter corresponding to respective amplitudes of the microphone output signal as the noise signal at the output of said variable gain circuit gradually increases;

detecting when a change in amplitude of the microphone output signal corresponding to said digital words does not match an increase in the output of said variable gain circuit, and noting the amplitude of said microphone output signal at that time; and causing said display to provide a visual indication of the amplitude of said microphone output signal at that time, thus providing an indication of the thermal limit of said electro-acoustic system;

analyzing the group delay of said electro-acoustic system by:

generating said oscillator frequency control input to cause said oscillator to generate a signal having a primary frequency component that sweeps from one end of a frequency spectrum to another;

receiving said phase indication signal from said phase comparator and determining from said phase indication signal the group delay of said electro-acoustic system as a function of the frequency designated by oscillator frequency control input; and causing said display to provide a visual indication of the magnitude of said group delay as a function of the frequency designated by oscillator frequency control input; and analyzing the spurious vibration of said electro-acoustic system by:

generating said frequency control signal for said band-reject filter and applying said frequency control signal to the frequency control input of said band-reject filter to cause the specified frequency of said filter to scan within said frequency spectrum so that a signal at the output of said band-reject filter has a wide band of frequency components substantially excluding said predetermined band of frequencies centered at the specified frequency corresponding to the value of said frequency control signal;

generating said frequency control signal for said band-pass filter and applying said frequency control signal to the frequency control input of said band-pass filter to cause the specified frequency of said band-pass filter to match the specified frequency of said band-reject filter so that the band-pass filtered signal has a primary frequency component at a frequency excluded from the output of said band-reject filter;

receiving the digital word from said second analog-to-digital converter corresponding to the amplitude of the band-pass filtered signal as said band-reject filter and said band-pass filter scan within said frequency spectrum, said microprocessor recording the amplitude of said band-pass filtered signal as a function of said frequency control signals; and causing said display to provide a visual indication of the amplitude of said band-pass filtered signal as a function of the specified frequency corresponding to said frequency control signals.

2. The analysis system of claim 1 wherein said low-pass filter, said high-pass filter, and said band-pass filter are formed by a state variable filter having low-pass, high-pass and band-pass outputs.

3. The analysis system of claim 1 wherein said first analog-to-distal converter comprise:

a peak hold circuit connected to the output of each of said low-pass filter, said high-pass filter, and said band-pass filter to generate respective peak value signals indicative of the peak values of said low-pass filtered signal, said high-pass filtered signal, and said band-pass filtered signal;

a multiplexer having an input connected to each of said peak hold circuits, said multiplexer having a signal selection input connected to said microprocessor to allow said microprocessor to selectively apply each of said peak value signals to a multiplexer output; and an analog-to-digital circuit having an input connected to said multiplexer output, said analog-to-digital circuit generating said digital word corresponding to the peak magnitude of the filtered signal selected by said multiplexer.

4. The analysis system of claim 1 wherein said microprocessor determines the high frequency bandwidth of said electro-acoustic system by setting said specified frequency for said high-pass and said band-pass filter above the expected high frequency bandwidth of said electro-acoustic system, and decreasing said specified frequency for said high-pass filter and said band-pass filter if the accumulated value for said high-pass filter is greater than the accumulated value for said band-pass filter, and selecting as the high frequency bandwidth the specified frequency at which the accumulated value for said high-pass filter becomes less than the accumulated value for said band-pass filter.

5. The analysis system of claim 1 wherein said microprocessor determines the low frequency bandwidth of said electro-acoustic system by setting said specified frequency for said low-pass and said band-pass filters above the expected low frequency bandwidth of said electro-acoustic system decreasing said specified frequency for said low-pass filter and said band-pass filter if the accumulated value for said low-pass filter is less than the accumulated value for said band-pass filter, and selecting as the low frequency bandwidth the specified frequency at which the accumulated value for said low-pass filter becomes greater than the accumulated value for said band-pass filter.

6. The analysis system of claim 1 wherein said first analog-to-digital converter generates respective digital words corresponding to the amplitudes of the outputs of at least two of said low-pass, high-pass, and band-pass filters each time the specified frequency of said filters is changed.

7. The analysis system of claim 1 further including a second high-pass filter coupling said random noise signal to said variable gain circuit to limit the intensity of low frequency components of signals applied to the electronic input of said electro-acoustic system.

8. The analysis system of claim 7 wherein the cutoff frequency of said second high-pass filter is substantially equal to the low frequency response of said electro-acoustic system.

9. The analysis system of claim 1, further including an RMS converter coupled to the electronic input of said electro-acoustic system, and a third analog-to-digital converter having an input coupled to an output of said RMS converter, said RMS converter output signal being an indicative of the power delivered to said acoustic transducer, said third analog-to-digital converter generating a power output signal that is coupled to said microprocessor so that said microprocessor can determine the thermal limit power of said electro-acoustic system.

10. The analysis system of claim 1 wherein said microprocessor generates said stimulus signal by:

generating said oscillator frequency control signal to cause the primary frequency component of said oscillator output signal to sweep from one portion of a frequency spectrum to another each time that said frequency control signal causes said specified frequency to change by a predetermined magnitude; and generating said second coupling control signal to couple the output of said oscillator to the electronic input of said electro-acoustic system.

11. The analysis system of claim 10 wherein said microprocessor sweeps the primary, frequency component of the oscillator output signal from a relatively high frequency in said frequency spectrum to a relatively low frequency in said frequency spectrum.

12. The analysis system of claim 10 wherein said microprocessor generates said oscillator frequency control signal to cause the primary frequency component of said oscillator output signal to change to each of a plurality of discrete oscillator frequencies at a zero crossing of said oscillator output signal, and wherein said oscillator output signal is maintained at each of said oscillator frequencies for the same duration so that said oscillator output signal has a substantially rectangular frequency spectrum.

13. The analysis system of claim 1 wherein said microprocessor generates said stimulus signal by:

generating said second coupling signal to couple the random noise signal at the output of said variable gain circuit to the electronic input of said electro-acoustic system.

14. The analysis system of claim 1 wherein said microprocessor further determines the thermal mass of said electro-acoustic system by generating a gain control signal to reduce the amplitude of said noise signal to a sufficient level and for a sufficient period to allow said acoustic transducer to cool after said analysis system has completed its analyses of the thermal limit of said electro-acoustic system, and said microprocessor then determines thermal mass by generating a gain control signal to quickly increase the power delivered to said acoustic transducer to said thermal limit, periodically receiving digital words from said second analog-to-digital converter indicative of the amplitude of said microphone output signal, detecting a predetermined decrease in the amplitude of said microphone output signal, determining the elapsed time from the increase in power delivered to said acoustic transducer to the detection of said predetermined decrease in the amplitude of said microphone output signal, and determining efficiency loss as a function of said elapsed time.

15. The analysis system of claim 1 wherein said phase comparator comprises:

a first signal compressor coupled to the electronic input of said electro-acoustic system, said signal compressor generating a first compressor output signal having a constant amplitude and a phase and frequency matching the phase and frequency of the signal that said coupling means applies to the electronic input of said electro-acoustic system;

a second signal compressor coupled to said microphone output signal, said signal compressor generating a second compressor output signal having a constant amplitude and a phase and frequency matching the phase and frequency of said microphone output signal;

a multiplier coupled to said first and second signal compressor, said multiplier generating a multiplier output signal derived from multiplying said first and second compressor output signals; and a second low-pass filter coupled to said multiplier for receiving said multiplier output signal, said second low-pass filter having an output generating a voltage indicative of the phase difference between said first and second compressor output signals.

16. The analysis system of claim 15 wherein said first and second signal compressors each comprise:

an RMS converter generating an output signal having a magnitude indicative of the RMS value of a signal applied to its input; and a voltage controlled amplifier generating an output signal having an amplitude that is a multiple of the amplitude of a signal applied to an amplifier input, said multiple being inversely proportional to the amplitude of a signal applied to a gain control input, said amplifier input being coupled to the input of said RMS converter, and said gain control input being coupled to the output signal of said RMS converter.

17. The analysis system of claim 1 wherein said microprocessor causes said display to plot group delay and the frequency response of said electro-acoustic system on a common frequency axis.

18. The analysis system of claim 1 wherein said band-reject filter comprises:

a low-pass filter attenuating frequency components of a signal applied to an input that are greater than a specified frequency corresponding to the value of a frequency control signal applied to a frequency control input, said low-pass filter input being coupled to said noise generator output and generating at an output a low-pass filtered noise signal;

a high-pass filter attenuating frequency components of a signal applied to an input that are less than a specified frequency corresponding to the value of a frequency control signal applied to a frequency control input, said frequency control input being coupled to the frequency control input of said low-pass filter so that said low-pass filter and said high-pass filter both have substantially the same specified frequency, said high-pass filter input being coupled to said noise generator output and generating at an output a high-pass filtered noise signal; and a combiner summing said low-pass filtered noise signal and said high-pass filtered noise signal.

19. The analysis system of claim 1 wherein said band-reject filter comprises a state variable filter having a low-pass output, a high-pass output, and a band-pass output, said low-pass output being combined with said high-pass output.

20. A system for determining the bandwidth of an electro-acoustic system of the type having an electronic input and an acoustic transducer generating an acoustic signal corresponding to an electrical signal applied to said electronic input, said system comprising:

a stimulus signal generator generating a stimulus signal having a frequency spectrum that encompasses the bandwidth of said electro-acoustic system, said stimulus signal being coupled to the electronic input of said electro-acoustic system;

a microphone acoustically coupled to the acoustic transducer of said electro-acoustic system and generating an output signal corresponding to said acoustic signal;

a low-pass filter attenuating frequency components of a signal applied to an input that are greater than a specified frequency corresponding to the value of a frequency control signal applied to a frequency control input, said low-pass filter input being coupled to the output of said microphone and generating at an output a low-pass filtered signal;

a high-pass filter attenuating frequency components of a signal applied to an input that are less than a specified frequency corresponding to the value of a frequency control signal applied to a frequency control input, said high-pass filter input being coupled to the output of said microphone and generating at an output a high-pass filtered signal;

a band-pass filter attenuating frequency components of a signal applied to an input that are significantly greater than and less than a specified frequency corresponding to the value of a frequency control signal applied to a frequency control input, said band-pass filter input being coupled to the output of said microphone and generating at an output a band-pass filtered signal;

an analog-to-digital converter having an input selectively coupled to the outputs of said low-pass filter, said high-pass filter, and said band-pass filter, said analog-to-digital converter generating at an output a digital word corresponding to the magnitude of a signal applied to its input;

a display for providing a visual indication of the results of said analysis corresponding to bandwidth analysis data; and a microprocessor coupled to said oscillator for generating said oscillator frequency control signal, said high-pass filter, low-pass filter, and band-pass filter for generating the frequency control signals for said high-pass filter, low-pass filter, and band-pass filter, said analog-to-digital converters for receiving respective digital words corresponding to the magnitude of said filtered signals, and said display for generating said analysis data, said microprocessor analyzing the bandwidth of said electro-acoustic system by:

generating a frequency control signal and applying said frequency control signal to the frequency control inputs of said high-pass, low-pass, and band-pass filters to cause said filters to have the same specified frequency and said specified frequency to sweep through at least a portion of said frequency spectrum while said stimulus signal is being applied to said electro-acoustic system;

recording the digital words from said first analog-to-digital converter corresponding to respective amplitudes of the signals output by said high-pass, low-pass, and band-pass filters to provide three sets of digital words each of which contain a record of the amplitudes of signals at the output of a respective filter at a plurality of specified frequencies;

accumulating the values of the digital words in each of said sets to provide a respective accumulated value for each of said high-pass, low-pass, and band-pass filters;

determining the high frequency response of said electro-acoustic system as the specified frequency at which the accumulated value for said band-pass filter is substantially equal to the accumulated value for said high-pass filter;

determining the low frequency response of said electro-acoustic system as the specified frequency at which the accumulated value for said band-pass filter is substantially equal to the accumulated value for said low-pass filter; and causing said display to provide a visual indication of said high frequency bandwidth and said low frequency bandwidth.

21. The analysis system of claim 20 wherein said low-pass filter, said high-pass filter, and said band-pass filter are formed by a state variable filter having low-pass, high-pass and band-pass outputs.

22. The analysis system of claim 20 wherein said analog-to-digital converter comprise:

a peak hold circuit connected to the output of each of said low-pass filter, said high-pass filter, and said band-pass filter to generate respective peak value signals indicative of the peak values of said low-pass filtered signal, said high-pass filtered signal, and said band-pass filtered signal;

a multiplexer having an input connected to each of said peak hold circuits, said multiplexer having a signal selection input connected to said microprocessor to allow said microprocessor to selectively apply each of said peak value signals to a multiplexer output; and an analog-to-digital circuit having an input connected to said multiplexer output, said analog-to-digital circuit generating said digital word corresponding to the magnitude of the filtered signal selected by said multiplexer.

23. The analysis system of claim 20 wherein said microprocessor determines the high frequency bandwidth of said electro-acoustic system by setting said specified frequency for said high-pass and said band-pass filter above the expected high frequency bandwidth of said electro-acoustic system, and decreasing said specified frequency for said high-pass filter and said band-pass filter if the accumulated value for said high-pass filter is greater than the accumulated value for said band-pass filter, and selecting as the high frequency bandwidth the specified frequency at which the accumulated value for said high-pass filter becomes less than the accumulated value for said band-pass filter.

24. The analysis system of claim 20 wherein said microprocessor determines the low frequency bandwidth of said electro-acoustic system by setting said specified frequency for said low-pass and said band-pass filters above the expected low frequency bandwidth of said electro-acoustic system, and decreasing said specified frequency for said low-pass filter and said band-pass filter if the accumulated value for said high-pass filter is less than the accumulated value for said band-pass filter, and selecting as the low frequency bandwidth the specified frequency at which the accumulated value for said low-pass filter becomes greater than the accumulated value for said band-pass filter.

25. The analysis system of claim 20 wherein said analog-to-digital converter generates respective digital words corresponding to the amplitudes of the outputs of at least two of said low-pass, high-pass, and band-pass filters each time the specified frequency of said filters is incrementally changed.

26. The analysis system of claim 20 wherein said stimulus signal generator comprises an oscillator generating an oscillator output signal having a primary frequency component determined by the value of an oscillator frequency control signal, and wherein said microprocessor generates said stimulus signal by generating said oscillator frequency control signal to cause the primary frequency component of said oscillator output signal to sweep from one portion of a frequency spectrum to another each time that said frequency control signal causes said specified frequency to change by a predetermined magnitude.

27. The analysis system of claim 26 wherein said microprocessor sweeps the primary frequency component of the oscillator output signal from a relatively high frequency in said frequency spectrum to a relatively low frequency in said frequency spectrum.

28. The analysis system of claim 26 wherein said microprocessor generates said oscillator frequency control signal to cause the primary frequency component of said oscillator output signal to incrementally change to each of a plurality of discrete oscillator frequencies at a zero crossing of said oscillator output signal, and wherein said oscillator output signal is maintained at each of said oscillator frequencies for the same duration so that said oscillator output signal has a substantially rectangular frequency spectrum.

29. The analysis system of claim 20 wherein said stimulus signal generator comprises a noise generator applying a random noise signal to the electronic input of said electro-acoustic system.

30. The analysis system of claim 29 wherein the frequency spectrum of said random noise signal is of uniform amplitude.

31. A system for determining the thermal limit of an electro-acoustic system of the type having an electronic input and an acoustic transducer generating an acoustic signal corresponding to an electrical signal applied to said electronic input, said system comprising:

a noise generator generating a random noise signal at a noise generator output, said noise generator output being coupled to the electronic input of said electro-acoustic system;

a variable gain circuit having an input coupled to said noise generator output, said variable gain circuit generating a signal at an output having a magnitude that is a product of the magnitude of a signal applied to its input and the value of a gain control signal applied to a gain control input;

a microphone acoustically coupled to the acoustic transducer of said electro-acoustic system and generating an output signal corresponding to said acoustic signal;

an analog-to-digital converter having an input coupled to said microphone said analog-to-digital converter generating at an output a digital word corresponding to the magnitude of a signal applied to its input; and a display for providing a visual indication of the results of said analysis corresponding to thermal limit analysis data; and a microprocessor coupled to said variable gain circuit for generating said gain control signal, said analog-to-digital converter for receiving said digital word corresponding to the magnitude of said acoustic signal, and said display for generating said thermal limit analysis data, said microprocessor analyzing the thermal power limit of said electro-acoustic system by:

generating said gain control signal to cause a noise signal at the output of said variable gain circuit to gradually increase in intensity;

receiving the digital words from said analog-to-digital converter corresponding to respective amplitudes of the microphone output signal as the noise signal at the output of said variable gain circuit gradually increases;

detecting when a change in amplitude of the microphone output signal corresponding to said distal words does not match an increase in the output of said variable gain circuit, and noting the amplitude of said microphone output signal at that time; and causing said display to provide a visual indication of the amplitude of said microphone output signal at that time, thus providing an indication of the thermal limit of said electro-acoustic system.

32. The analysis system of claim 31, further including a second high-pass filter coupling said random noise signal to said variable gain circuit to limit the intensity of low frequency signals applied to the electronic input of said electro-acoustic system.

33. The analysis system of claim 32 wherein the cutoff frequency of said second high-pass filter is substantially equal to the low frequency response of said electro-acoustic system.

34. The analysis system of claim 31, further including an RMS converter coupled to the electronic input of said electro-acoustic system, and a third analog-to-digital converter having an input coupled to an output of said RMS converter, said RMS converter output signal being an indicative of the power delivered to said acoustic transducer, said third analog-to-digital converter generating a power output signal that is coupled to said microprocessor so that said microprocessor can determine the thermal limit power of said electro-acoustic system.

35. The analysis system of claim 31 wherein said microprocessor further determines the thermal mass of said electro-acoustic system by generating a gain control signal to reduce the amplitude of said noise signal to a sufficient level and for a sufficient period to allow said acoustic transducer to cool after said analysis system has completed its analyses of the thermal limit of said electro-acoustic system, and said microprocessor then determines thermal mass by generating a gain control signal to quickly increase the power delivered to said acoustic transducer to said thermal limit, periodically receiving digital words from said analog-to-digital converter indicative of the amplitude of said microphone output signal, detecting a predetermined decrease in the amplitude of said microphone output signal, determining the elapsed time from the increase in power delivered to said acoustic transducer to the detection of said predetermined decrease in the amplitude of said microphone output signal, and determining the thermal mass as a function of said elapsed time.

36. A system for analyzing the group delay of an electro-acoustic system of the type having an electronic input and an acoustic transducer generating an acoustic signal corresponding to an electrical signal applied to said electronic input, said system comprising:

an oscillator generating an oscillator output signal having a primary frequency component determined by the value of an oscillator frequency control signal, said oscillator output being coupled to the electronic input of said electro-acoustic system;

a microphone acoustically coupled to the acoustic transducer of said electro-acoustic system and generating an output signal corresponding to said acoustic signal;

a phase comparator coupled to said oscillator to receive said oscillator output signal and to said microphone to receive said microphone output signal, said comparator providing a phase indication signal corresponding to the difference in phase between said oscillator output signal and said microphone output signal;

a display for providing a visual indication of the results of said analysis corresponding to group delay analysis data; and a microprocessor coupled to said oscillator for generating said oscillator frequency control signal, said phase comparator for receiving said phase indication signal, and said display for generating said group delay analysis data, said microprocessor analyzing the group delay of said electro-acoustic system by:

generating said oscillator frequency control input to cause said oscillator to generate a signal having a primary frequency component that sweeps from one end of a frequency spectrum to another;

receiving said phase indication signal from said phase comparator and determining from said phase indication signal the group delay of said electro-acoustic system as a function of the frequency designated by oscillator frequency control input; and causing said display to provide a visual indication of the magnitude of said group delay as a function of the frequency designated by oscillator frequency control input.

37. The analysis system of claim 36 wherein said phase comparator comprises:

a first signal compressor coupled to the electronic input of said electro-acoustic system, said signal compressor generating a first compressor output signal having a constant amplitude and a phase and frequency matching the phase and frequency of the signal that said oscillator applies to the electronic input of said electro-acoustic system;

a second signal compressor coupled to said microphone output signal, said signal compressor generating a second compressor output signal having a constant amplitude and a phase and frequency matching the phase and frequency of said microphone output signal;

a multiplier coupled to said first and second signal compressor, said multiplier generating a multiplier output signal derived from multiplying said first and second compressor output signals; and a low-pass filter coupled to said multiplier for receiving said mixer output signal, said low-pass filter having an output generating a voltage indicative of the phase difference between said first and second compressor output signals.

38. The analysis system of claim 37 wherein said first and second signal compressors each comprise:

an RMS converter generating an output signal having a magnitude indicative of the RMS value of a signal applied to its input; and a voltage controlled amplifier generating an output signal having an amplitude that is a multiple of the amplitude of a signal applied to an amplifier input, said multiple being inversely proportional to the amplitude of a signal applied to a gain control input, said amplifier input being coupled to the input of said RMS converter, and said gain control input being coupled to the output signal of said RMS converter.

39. The analysis system of claim 36 wherein said microprocessor causes said display to plot group delay and the frequency response of said electro-acoustic system on a common frequency axis.

40. A system for analyzing the spurious vibration of an electro-acoustic system of the type having an electronic input and an acoustic transducer generating an acoustic signal corresponding to an electrical signal applied to said electronic input, said system comprising:

a noise generator generating a random noise signal at a noise generator output;

a band-reject filter attenuating frequency components of a signal applied to an input that are within a predetermined band of frequencies centered at a specified frequency corresponding to the value of a frequency control signal applied to a frequency control input, said band-reject filter input being coupled to said noise generator output and generating at an output a band-reject filtered signal that is coupled to the electronic input of said electro-acoustic system;

a band-pass filter attenuating frequency components of a signal applied to an input that are significantly greater than and less than a specified frequency corresponding to the value of a frequency control signal applied to a frequency control input, said band-pass filter input being coupled to the output of said microphone and generating at an output a band-pass filtered signal;

an analog-to-digital converter having an input coupled to the output of said band-pass filter, said analog-to-digital converter generating at an output a digital word corresponding to the magnitude of a signal applied to its input;

a display for providing a visual indication of the results of said analysis corresponding to spurious vibration analysis data; and a microprocessor coupled to said band-reject filter for generating the frequency control signal for said band-reject filter, said band-pass filter for generating the frequency control signal for said band-pass filter, said analog-to-digital converter for receiving said digital word corresponding to the magnitude of said band-pass filtered signal, and said display for generating said spurious vibration analysis data, said microprocessor analyzing the spurious vibration of said electro-acoustic system by:

generating said frequency control signal for said band-reject filter and applying said frequency control signal to the frequency control input of said band-reject filter to cause the specified frequency of said filter to scan within said frequency spectrum so that a signal at the output of said band-reject filter has a wide band of frequency components substantially excluding said predetermined band of frequencies centered at the specified frequency corresponding to the value of said frequency control signal;

generating said frequency control signal for said band-pass filter and applying said frequency control signal to the frequency control input of said band-pass filter to cause the specified frequency of said band-pass filter to match the specified frequency of said band-reject filter so that the band-pass filtered signal has a primary frequency component at a frequency excluded from the output of said band-reject filter;

receiving the digital word from said analog-to-distal converter corresponding to the amplitude of the band-pass filtered signal as said band-reject filter and said band-pass filter scan within said frequency spectrum, said microprocessor recording the amplitude of said band-pass filtered signal as a function of said frequency control signal; and causing said display to provide a visual indication of the amplitude of said band-pass filtered signal as a function of the specified frequency corresponding to said frequency control signal.

41. The analysis system of claim 40 wherein said band-reject filter comprises:

a low-pass filter attenuating frequency components of a signal applied to an input that are greater than a specified frequency corresponding to the value of a frequency control signal applied to a frequency control input, said low-pass filter input being coupled to said noise generator output and generating at an output a low-pass filtered noise signal;

a high-pass filter attenuating frequency components of a signal applied to an input that are less than a specified frequency corresponding to the value of a frequency control signal applied to a frequency control input, said frequency control input being coupled to the frequency control input of said low-pass filter so that said low-pass filter and said high-pass filter both have substantially the same specified frequency, said high-pass filter input being coupled to said noise generator output and generating at an output a high-pass filtered noise signal;

a combiner summing said low-pass filtered noise signal and said high-pass filtered noise signal.

42. The analysis system of claim 40 wherein said band-reject filter comprises a state variable filter having a low-pass output, a high-pass output, and a band-pass output, said low-pass output being combined with said high-pass output.

43. A method of analyzing an electro-acoustic system of the type having an electronic input and an acoustic transducer generating an acoustic signal corresponding to an electrical signal applied to said electronic input, said method comprising:

analyzing the bandwidth of said electro-acoustic system by:

generating a stimulus signal having a frequency spectrum that encompasses the bandwidth of said electro-acoustic system;

coupling said stimulus signal to the electronic input of said electro-acoustic system;

generating an output signal corresponding to the acoustic signal from the acoustic transducer of said electro-acoustic system;

attenuating frequency components of said output signal that are greater than a specified frequency to generate a low-pass filtered signal;

attenuating frequency components of said output signal that are less than said specified frequency to generate a high-pass filtered signal;

attenuating frequency components of said output signal that are significantly greater than and less than said specified frequency to generate a band-pass filtered signal;

incrementally changing said specified frequency within said frequency spectrum while said stimulus signal is being applied to said electro-acoustic system;

accumulating the respective amplitudes of said low-pass filtered signal, said high-pass filtered signal and said band-pass filtered signal at each of a plurality of specified frequencies to provide a respective accumulated value for each of said high-pass, low-pass, and band-pass filtered signals;

determining the high frequency response of said electro-acoustic system as the specified frequency at which the accumulated value for said band-pass filtered signal is substantially equal to the accumulated value for said high-pass filtered signal; and determining the low frequency response of said electro-acoustic system as the specified frequency at which the accumulated value for said band-pass filtered signal is substantially equal to the accumulated value for said low-pass filtered signal; and analyzing the thermal power limit of said electro-acoustic system by:

generating a random noise signal and applying said random noise signal to the electronic input of said electro-acoustic system;

gradually increasing the intensity of said random noise signal;

monitoring the amplitude of an output signal corresponding to the acoustic signal from the acoustic transducer of said electro-acoustic system as the intensity of said random noise signal gradually increases;

detecting when a change in amplitude of the output signal does not match an increase in the intensity of said random noise signal, and noting the amplitude of said output signal at that time thus providing an indication of the thermal limit of said electro-acoustic system; and analyzing the group delay of said electro-acoustic system by:

generating an oscillator signal having a primary frequency component that sweeps from one end of a frequency spectrum to another;

generating an output signal corresponding to the acoustic signal from the acoustic transducer of said electro-acoustic system;

comparing the phase of said oscillator signal with the phase of said output signal; and determining from said phase comparison the group delay of said electro-acoustic system as a function of said primary frequency component; and analyzing the spurious vibration of said electro-acoustic system by:

generating a filtered random noise signal substantially excluding frequency components that are within a predetermined range of frequencies;

applying said filtered random noise signal to the electronic input of said electro-acoustic system;

generating an output signal corresponding to the acoustic signal from the acoustic transducer of said electro-acoustic system;

attenuating frequency components of said output signal that are outside of said predetermined range of frequencies to generate a filtered signal having frequency components that are substantially excluded from said filtered random noise signal;

scanning said specified frequency within said frequency spectrum; and recording the amplitude of said filtered signal as a function of said specified frequency.

44. The method of claim 43 wherein the high frequency bandwidth of said electro-acoustic system is determined by setting said specified frequency for said high-pass and said band-pass filter signals above the expected high frequency bandwidth of said electro-acoustic system, and decreasing said specified frequency for said high-pass filtered sisal and said band-pass filtered signal if the accumulated value for said high-pass filtered signal is greater than the accumulated value for said band-pass filtered signal, and selecting as the high frequency bandwidth the specified frequency at which the accumulated value for said high-pass filtered signal becomes less than the accumulated value for said band-pass filtered signal to less than the accumulated value for said band-pass filtered signal.

45. The method of claim 43 wherein the low frequency bandwidth of said electro-acoustic system is determined by setting said specified frequency for said low-pass and said band-pass filtered signals above the expected low frequency bandwidth of said electro-acoustic system, and decreasing said specified frequency for said low-pass filtered signal and said band-pass filtered signal if the accumulated value for said low-pass filtered signal is less than the accumulated value for said band-pass filtered signal, and selecting as the low frequency bandwidth the specified frequency at which the accumulated value for said low-pass filtered signal becomes greater than the accumulated value for said band-pass filtered signal.

46. The method of claim 43 wherein said stimulus signal is generated by generating an oscillator signal having a primary frequency component that sweeps from one portion of said frequency spectrum to another each time that said specified frequency is changed by a predetermined magnitude.

47. The method of claim 46 wherein in performing said step of analyzing the bandwidth of said electro-acoustic system the primary frequency component of said oscillator signal sweeps from a relatively high frequency in said frequency spectrum to a relatively low frequency in said frequency spectrum.

48. The method of claim 46 wherein in performing said step of analyzing the bandwidth of said electro-acoustic system the primary frequency component of said oscillator signal incrementally changes to each of a plurality of discrete frequencies at a zero crossing of said oscillator signal, and wherein said oscillator signal is maintained at each of said discrete frequencies for the same duration so that said oscillator signal has a substantially rectangular frequency spectrum.

49. The method of claim 43 wherein said stimulus signal is generated by generating a random noise signal.

50. The method of claim 49 wherein the frequency spectrum of said random noise signal has a uniform amplitude.

51. The method of claim 43 wherein in said step of analyzing the thermal power limit of said electro-acoustic system said random noise signal applied to the electronic input of said electro-acoustic system contains frequency components that are substantially attenuated below the low frequency bandwidth of said electro-acoustic system.

52. The method of claim 43 wherein said step of analyzing the thermal power limit of said electro-acoustic system further includes the step of measuring the power delivered to said acoustic transducer.

53. The method of claim 43, further including the step of determining the thermal mass of said electro-acoustic system by:

reducing the amplitude of said noise signal to a sufficient level and for a sufficient period to allow said acoustic transducer to cool after the thermal limit of said electro-acoustic system has been analyzed;

quickly increasing the power delivered to said acoustic transducer to said thermal limit;

detecting a predetermined decrease in the amplitude of said output signal;

determining the elapsed time from the increase in power delivered to said acoustic transducer to the detection of said predetermined decrease in the amplitude of said output signal; and determining the thermal mass as a function of said elapsed time.

54. The method of claim 43 wherein said step of comparing the phase of said oscillator signal with the phase of said output signal to analyze the group delay of said electro-acoustic system is accomplished by:

generating a first phase reference signal having a constant amplitude and a phase and frequency matching the phase and frequency of the signal applied to the electronic input of said electro-acoustic system;

generating a second phase reference signal having a constant amplitude and a phase and frequency matching the phase and frequency of said output signal;

multiplying said first and second phase reference signals to generate a multiplied signal; and low-pass filtering said multiplied signal to generate a voltage indicative of the phase difference between said first and second phase reference signals.

55. The method of claim 43, further including the step of plotting group delay and the frequency response of said electro-acoustic system on a common frequency axis.

56. A method of analyzing the bandwidth of an electro-acoustic system of the type having an electronic input and an acoustic transducer generating an acoustic signal corresponding to an electrical signal applied to said electronic input, said method comprising:

generating a stimulus signal having a frequency spectrum that encompasses the bandwidth of said electro-acoustic system;

coupling said stimulus signal to the electronic input of said electro-acoustic system;

generating an output signal corresponding to the acoustic signal from the acoustic transducer of said electro-acoustic system;

attenuating frequency components of said output signal that are greater than a specified frequency to generate a low-pass filtered signal;

attenuating frequency components of said output signal that are less than said specified frequency to generate a high-pass filtered signal;

attenuating frequency components of said output signal that are significantly greater than and less than said specified frequency to generate a band-pass filtered signal;

incrementally changing said specified frequency within said frequency spectrum while said stimulus signal is being applied to said electro-acoustic system;

accumulating the respective amplitudes of said low-pass filtered signal, said high-pass filtered signal and said band-pass filtered signal at each of a plurality of specified frequencies to provide a respective accumulated value for each of said high-pass, low-pass, and band-pass filtered signals;

determining the high frequency response of said electro-acoustic system as the specified frequency at which the accumulated value for said band-pass filtered signal is substantially equal to the accumulated value for said high-pass filtered signal; and determining the low frequency response of said electro-acoustic system as the specified frequency at which the accumulated value for said band-pass filtered signal is substantially equal to the accumulated value for said low-pass filtered signal.

57. The method of claim 56 wherein the high frequency bandwidth of said electro-acoustic system is determined by setting said specified frequency for said high-pass and said band-pass filtered signals above the expected high frequency bandwidth of said electro-acoustic system, and decreasing said specified frequency for said high-pass filtered signal and said band-pass filtered signal if the accumulated value for said high-pass filtered signal is greater than the accumulated value for said band-pass filtered signal, and selecting as the high frequency bandwidth the specified frequency at which the accumulated value for said high-pass filtered sisal becomes less than the accumulated value for said band-pass filtered signal.

58. The method of claim 56 wherein the low frequency bandwidth of said electro-acoustic system is determined by setting said specified frequency for said low-pass and said high-pass filtered signals above the expected low frequency bandwidth of said electro-acoustic system, and decreasing said specified frequency for said low-pass filtered signal and said band-pass filtered signal if the accumulated value for said low-pass filtered signal is less than the accumulated value for said band-pass filtered signal, and selecting as the low frequency bandwidth the specified frequency at which the accumulated value for said low-pass filtered signal becomes greater than the accumulated value for said band-pass filtered signal.

59. The method of claim 56 wherein said stimulus signal is generated by generating an oscillator signal having a primary frequency component that sweeps from one portion of said frequency spectrum to another each time that said specified frequency is changed by a predetermined magnitude.

60. The method of claim 59 wherein in performing said step of analyzing the bandwidth of said electro-acoustic system the primary frequency component of said oscillator signal sweeps from a relatively high frequency in said frequency spectrum to a relatively low frequency in said frequency spectrum.

61. The method of claim 59 wherein in performing said step of analyzing the bandwidth of said electro-acoustic system the primary frequency component of said oscillator signal incrementally changes to each of a plurality of discrete frequencies at a zero crossing of said oscillator signal, and wherein said oscillator signal is maintained at each of said discrete frequencies for the same duration so that said oscillator signal has a substantially rectangular frequency spectrum.

62. The method of claim 56 wherein said stimulus signal is generated by generating a random noise signal.

63. The method of claim 62 wherein the frequency spectrum of said random noise signal has a uniform amplitude.

64. A method of analyzing the thermal power limit of an electro-acoustic system of the type having an electronic input and an acoustic transducer generating an acoustic signal corresponding to an electrical signal applied to said electronic input, said method comprising:

generating a random noise signal and applying said random noise signal to the electronic input of said electro-acoustic system;

gradually increasing the intensity of said random noise signal;

monitoring the amplitude of an output signal corresponding to the acoustic signal from the acoustic transducer of said electro-acoustic system as the intensity of said random noise signal gradually increases; and detecting when a change in amplitude of the output signal does not match an increase in the intensity of said random noise signal, and noting the amplitude of said output signal at that time thus providing an indication of the thermal limit of said electro-acoustic system.

65. The method of claim 64 wherein in said step of analyzing the thermal power limit of said electro-acoustic system said random noise signal applied to the electronic input of said electro-acoustic system contains frequency components that are substantially attenuated below the low frequency bandwidth of said electro-acoustic system.

66. The method of claim 64 wherein said step of analyzing the thermal power limit of said electro-acoustic system further includes the step of measuring the power delivered to said acoustic transducer.

67. The method of claim 64, further including the step of determining the thermal mass of said electro-acoustic system by:

reducing the amplitude of said noise signal to a sufficient level and for a sufficient period to allow said acoustic transducer to cool after the thermal limit of said electro-acoustic system has been analyzed;

quickly increasing the power delivered to said acoustic transducer to said thermal limit; detecting a predetermined decrease in the amplitude of said output signal; determining the elapsed time from the increase in power delivered to said acoustic transducer to the detection of said predetermined decrease in the amplitude of said output signal; and determining the thermal mass as a function of said elapsed time.

68. A method of analyzing the group delay of an electro-acoustic system of the type having an electronic input and an acoustic transducer generating an acoustic signal corresponding to an electrical signal applied to said electronic input, said method comprising:

generating an oscillator signal having a primary frequency component that sweeps from one end of a frequency spectrum to another and applying said oscillator signal to the electronic input of said electro-acoustic system;

generating an output signal corresponding to the acoustic signal from the acoustic transducer of said electro-acoustic system:

generating a first phase reference signal having a constant amplitude and a phase and frequency matching the phase and frequency of the signal applied to the electronic input of said electro-acoustic system;

generating a second phase reference signal having a constant amplitude and phase and frequency matching the phase and frequency of said output signal;

multiplying said first and second phase reference signals to generate a multiplied signal;

low-pass filtering said multiplied signal to generate a voltage indicative of the phase difference between said first and second phase reference signal; and determining from said phase difference the group delay of said electro-acoustic system as a function of said primary frequency component.

69. A method of analyzing a group delay of an electro-acoustic system of the type having an electronic input and an acoustic transducer generating an acoustic signal corresponding to an electrical signal applied to said electronic input, said method comprising:

generating an oscillator signal having a primary frequency component that sweeps from one end of a frequency spectrum to another and applying said oscillator signal to the electronic input of said electro-acoustic system:

generating an output signal corresponding to the acoustic signal from the acoustic transducer of said electro-acoustic system;

comparing the phase of said oscillator signal with the phase of said output signal; and determining from said phase comparison the group delay of said electro-acoustic system as a function of said primary frequency component; and plotting group delay and the frequency response of said electro-acoustic system on a common frequency axis.

70. A method of analyzing the spurious vibration of an electro-acoustic system over a predetermined frequency spectrum, said electro-acoustic system being of the type having an electronic input and an acoustic transducer generating an acoustic signal corresponding to an electrical signal applied to said electronic input, said method comprising:

generating a filtered random noise signal substantially excluding frequency components that are within a predetermined range of frequencies centered at a specified frequency;

applying said filtered random noise signal to the electronic input of said electro-acoustic system;

generating an output signal corresponding to the acoustic signal from the acoustic transducer of said electro-acoustic system;

attenuating frequency components of said output signal that are outside of said predetermined range of frequencies centered at said specified frequency to generate a filtered output signal having frequency components that are substantially excluded from said filtered random noise signal;

scanning said specified frequency within said frequency spectrum; and recording the amplitude of said filtered output signal as a function of said specified frequency.

* * * * *

UNITED STATES PATENT AND TRADEMARK OFFICE

CERTIFICATE OF CORRECTION

PATENT NO. : 5,555,311
DATED : September 10, 1996
INVENTOR(S) : Robert W. Reams

It is certified that error appears in the above-indentified patent and that said Letters Patent is hereby corrected as shown below:

In column 21, claim 1, line 12, please delete "distal" and insert therefor --digital--.

In column 23, claim 11, line 49, please delete ",".

In column 28, claim 31, line 31, please delete "distal" and insert therefor --digital--.

In column 31, claim 40, line 15, please delete "distal" and insert therefor --digital--.

In column 33, claim 44, line 14, please delete "sisal" and insert therefor --signal--.

In column 35, claim 57, line 27, please delete "sisal" and insert therefor --signal--.

Signed and Sealed this

Twenty-first Day of January, 1997

*Attest:*

Bruce Lehman

BRUCE LEHMAN

*Attesting Officer*

*Commissioner of Patents and Trademarks*